US011027905B2

(12) United States Patent
Ford

(10) Patent No.: US 11,027,905 B2
(45) Date of Patent: Jun. 8, 2021

(54) CARRIER, BLANK AND METHOD FOR CONTAINERS

(71) Applicant: Graphic Packaging International, LLC, Atlanta, GA (US)

(72) Inventor: Colin P. Ford, Woodstock, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 16/562,957

(22) Filed: Sep. 6, 2019

(65) Prior Publication Data

US 2020/0079564 A1 Mar. 12, 2020

Related U.S. Application Data

(60) Provisional application No. 62/728,454, filed on Sep. 7, 2018, provisional application No. 62/767,188, filed on Nov. 14, 2018, provisional application No. 62/770,566, filed on Nov. 21, 2018.

(51) Int. Cl.

| | |
|---|---|
| ***B65D 71/50*** | (2006.01) |
| ***B65D 71/42*** | (2006.01) |
| ***B65B 17/02*** | (2006.01) |

(52) U.S. Cl.

CPC ..... *B65D 71/50* (2013.01); *B65B 17/025* (2013.01); *B65D 71/42* (2013.01)

(58) Field of Classification Search

CPC ..... B65D 5/42; B65D 71/12; B65D 71/40; B65D 71/44; B65D 71/46; B65D 71/50;

(Continued)

(56) References Cited

U.S. PATENT DOCUMENTS

| | | | |
|---|---|---|---|
| 1,527,399 | A | 2/1925 | Davidson |
| 2,289,859 | A | 7/1942 | Arthur |

(Continued)

FOREIGN PATENT DOCUMENTS

| | | |
|---|---|---|
| CA | 2133827 | 10/1993 |
| DE | 10 2009 059 047 A1 | 6/2011 |

(Continued)

OTHER PUBLICATIONS

International Search Report and Written Opinion for PCT/US2019/049900 dated Sep. 3, 2020.

(Continued)

*Primary Examiner* — Bryon P Gehman

(74) *Attorney, Agent, or Firm* — Womble Bond Dickinson (US) LLP

(57) ABSTRACT

A carrier for holding a plurality of containers includes a central panel for engaging the plurality of containers and at least one attachment feature in the central panel that receives and holds a top portion of at least one container of the plurality of containers. The at least one attachment feature includes an opening in the central panel, a first retention feature, and a second retention feature. The first retention feature and the second retention feature includes a respective first retention edge and second retention edge of the central panel defining a respective first portion and a second portion of the opening and for engaging a respective first portion and a second portion of at least one container of the plurality of containers to at least partially attach the at least one container to the carrier.

33 Claims, 21 Drawing Sheets

(58) Field of Classification Search
CPC ..... B65D 71/52; B65D 71/75; B65D 71/42; B65B 17/02; B65B 17/025
USPC ..... 206/145, 153, 158
See application file for complete search history.

(56) References Cited

U.S. PATENT DOCUMENTS

| | | | | |
|---|---|---|---|---|
| 2,320,440 | A * | 6/1943 | Kruea | B65D 71/406 206/158 |
| 2,522,950 | A | 9/1950 | Keith | |
| 2,737,326 | A | 3/1956 | Toensmeier | |
| 2,798,603 | A | 7/1957 | Grinspoon | |
| 2,950,041 | A | 8/1960 | Stone | |
| 2,965,410 | A | 12/1960 | Hughes | |
| 3,061,141 | A | 10/1962 | Cote | |
| 3,118,537 | A | 1/1964 | Copping | |
| 3,137,109 | A | 6/1964 | Rapata | |
| 3,200,944 | A | 8/1965 | Rapata | |
| 3,245,711 | A | 4/1966 | Dantoin | |
| 3,281,180 | A | 10/1966 | Spery | |
| 3,387,879 | A | 6/1968 | Wood | |
| 3,528,697 | A | 9/1970 | Wood | |
| 3,587,847 | A | 6/1971 | Graser | |
| 3,601,439 | A | 8/1971 | Poupitch | |
| 3,627,121 | A | 12/1971 | Deasy | |
| 3,653,503 | A | 4/1972 | Arneson | |
| 3,693,787 | A | 9/1972 | Duerr | |
| 3,726,558 | A | 4/1973 | Klygis | |
| 3,734,278 | A | 5/1973 | Kerrigan | |
| 3,897,873 | A | 8/1975 | Graser | |
| 3,924,739 | A | 12/1975 | Gravesteijn | |
| 3,942,631 | A | 3/1976 | Sutherland et al. | |
| 4,029,204 | A | 6/1977 | Manizza | |
| 4,155,502 | A | 5/1979 | Forte | |
| 4,304,329 | A | 12/1981 | Graser | |
| 4,339,032 | A | 7/1982 | Wood | |
| 4,372,599 | A | 2/1983 | Kiedaisch et al. | |
| 4,378,879 | A | 4/1983 | Killy | |
| 4,382,505 | A | 5/1983 | Sutherland et al. | |
| 4,441,611 | A | 4/1984 | Sommariva | |
| 4,471,870 | A | 9/1984 | Uhlig | |
| 4,523,676 | A | 6/1985 | Barrash | |
| 4,784,266 | A | 11/1988 | Chaussadas | |
| 4,911,288 | A | 3/1990 | Dantoin, Jr. | |
| 4,974,726 | A | 12/1990 | Klygis et al. | |
| 5,002,225 | A | 3/1991 | Bienaime | |
| 5,125,506 | A | 6/1992 | Galbierz et al. | |
| 5,139,147 | A | 8/1992 | Sutherland | |
| 5,188,225 | A | 2/1993 | Jorba | |
| 5,193,673 | A | 3/1993 | Rathbone et al. | |
| 5,201,412 | A | 4/1993 | Schuster et al. | |
| 5,230,425 | A | 7/1993 | Edqvist et al. | |
| 5,246,113 | A | 9/1993 | Schuster | |
| 5,263,299 | A | 11/1993 | Galbierz et al. | |
| 5,267,644 | A | 12/1993 | Tsao | |
| 5,282,348 | A | 2/1994 | Dampier et al. | |
| 5,297,673 | A | 3/1994 | Sutherland | |
| 5,310,050 | A | 5/1994 | Sutherland | |
| 5,310,051 | A | 5/1994 | Sutherland | |
| 5,318,178 | A | 6/1994 | Davies et al. | |
| 5,323,895 | A | 6/1994 | Sutherland et al. | |
| 5,328,024 | A | 7/1994 | Sutherland | |
| 5,351,815 | A | 10/1994 | Fogle et al. | |
| 5,351,816 | A | 10/1994 | Sutherland et al. | |
| 5,351,817 | A | 10/1994 | Sutherland | |
| 5,355,999 | A | 10/1994 | Sutherland | |
| 5,360,104 | A | 11/1994 | Sutherland | |
| 5,390,784 | A | 2/1995 | Sutherland | |
| 5,407,065 | A | 4/1995 | Sutherland | |
| 5,415,278 | A | 5/1995 | Sutherland | |
| 5,443,153 | A | 8/1995 | Sutherland | |
| 5,445,262 | A | 8/1995 | Sutherland | |
| 5,452,799 | A | 9/1995 | Sutherland | |
| 5,484,053 | A | 1/1996 | Harris | |
| 5,485,914 | A | 1/1996 | Martin | |
| 5,487,464 | A | 1/1996 | Galbierz et al. | |
| 5,503,267 | A | 4/1996 | Sutherland | |
| 5,520,283 | A | 5/1996 | Sutherland | |
| 5,524,756 | A | 6/1996 | Sutherland | |
| 5,551,566 | A | 9/1996 | Sutherland | |
| 5,553,705 | A | 9/1996 | Bakx | |
| 5,590,776 | A | 1/1997 | Galbierz | |
| 5,593,027 | A | 1/1997 | Sutherland | |
| 5,609,247 | A | 3/1997 | Appleton | |
| 5,682,982 | A | 11/1997 | Stonehouse | |
| 5,706,936 | A | 1/1998 | Bernstein | |
| 5,711,419 | A | 1/1998 | Beales et al. | |
| 5,746,310 | A | 5/1998 | Slomski | |
| 5,762,193 | A | 6/1998 | Marco | |
| 5,791,463 | A | 8/1998 | Negelen | |
| 5,816,391 | A | 10/1998 | Harris | |
| 5,845,776 | A | 12/1998 | Galbierz et al. | |
| 5,878,876 | A | 3/1999 | Galbierz et al. | |
| 5,960,945 | A | 10/1999 | Sutherland | |
| 6,039,181 | A | 3/2000 | Whiteside | |
| 6,059,099 | A | 5/2000 | Galbierz | |
| 6,082,532 | A * | 7/2000 | Miess | B65D 71/44 206/158 |
| 6,145,656 | A | 11/2000 | Marco | |
| 6,315,111 | B1 | 11/2001 | Sutherland | |
| 6,394,272 | B1 | 5/2002 | Domansky | |
| 6,896,130 | B2 | 5/2005 | Theelen | |
| 7,011,209 | B2 | 3/2006 | Sutherland et al. | |
| 7,690,507 | B2 | 4/2010 | Sutherland | |
| 7,721,878 | B2 | 5/2010 | Requena | |
| 7,762,397 | B2 | 7/2010 | Coltri-Johnson et al. | |
| 7,789,231 | B2 | 9/2010 | Requena | |
| 7,823,721 | B2 | 11/2010 | Sutherland et al. | |
| 8,096,413 | B2 * | 1/2012 | Coltri De Paula | B65D 71/42 206/153 |
| 8,162,135 | B2 | 4/2012 | Oliveira | |
| 8,353,398 | B2 | 1/2013 | DePaula et al. | |
| 8,387,784 | B2 | 3/2013 | Gonzalez et al. | |
| 8,443,968 | B2 * | 5/2013 | De Paula | B65D 71/42 206/153 |
| 8,464,866 | B2 | 6/2013 | Sutherland et al. | |
| 8,469,184 | B2 | 6/2013 | Spivey, Sr. | |
| 8,602,209 | B2 | 12/2013 | Jones et al. | |
| 8,631,932 | B2 | 1/2014 | Holley, Jr. | |
| 8,701,878 | B2 | 4/2014 | Spivey, Sr. | |
| 8,925,720 | B2 | 1/2015 | Sutherland et al. | |
| 8,936,149 | B2 | 1/2015 | Smalley | |
| 8,955,674 | B2 | 2/2015 | Spivey, Sr. et al. | |
| 9,079,699 | B2 | 7/2015 | Holley, Jr. | |
| 9,169,050 | B2 | 10/2015 | Spivey, Sr. | |
| 9,359,093 | B2 | 6/2016 | DePaula et al. | |
| 9,446,891 | B2 | 9/2016 | Jones et al. | |
| 9,511,916 | B2 | 12/2016 | Holley, Jr. | |
| 9,669,976 | B2 | 6/2017 | Kastanek et al. | |
| 9,676,535 | B2 | 6/2017 | Spivey, Sr. | |
| 2002/0195371 | A1 | 12/2002 | Brown | |
| 2003/0080004 | A1 | 5/2003 | Olsen et al. | |
| 2003/0213705 | A1 | 11/2003 | Woog | |
| 2004/0211695 | A1 | 10/2004 | Karlsson | |
| 2005/0127151 | A1 | 6/2005 | Johnson | |
| 2009/0101526 | A1 | 4/2009 | Sutherland et al. | |
| 2009/0127147 | A1 | 5/2009 | Sutherland | |
| 2010/0078337 | A1 | 4/2010 | Sutherland et al. | |
| 2010/0264043 | A1 | 10/2010 | DePaula | |
| 2015/0191287 | A1 | 7/2015 | L'Heureux et al. | |
| 2016/0325899 | A1 | 11/2016 | L'Heureux et al. | |
| 2018/0362234 | A1 | 12/2018 | L'Heureux et al. | |
| 2019/0119019 | A1 | 4/2019 | Patton | |
| 2020/0189819 | A1 * | 6/2020 | McCree | B65D 71/42 |
| 2020/0189821 | A1 | 6/2020 | Smalley | |

FOREIGN PATENT DOCUMENTS

| | | | | |
|---|---|---|---|---|
| EP | 0 051 413 | A1 | 5/1982 | |
| EP | 0 060 504 | A2 | 9/1982 | |
| EP | 0 057 437 | B1 | 5/1985 | |
| EP | 0 636 096 | | 2/1995 | |
| EP | 0 398 835 | B1 | 10/1996 | |
| EP | 2067713 | A1 * | 6/2009 | B65D 71/42 |

(56) References Cited

FOREIGN PATENT DOCUMENTS

| | | | | |
|---|---|---|---|---|
| EP | 1 528 007 61 | | 10/2010 | |
| EP | 3 666 684 | A1 | 6/2020 | |
| FR | 2 737 196 | A1 | 1/1997 | |
| GB | 2 321 229 | A | 7/1998 | |
| JP | 10-297668 | A | 11/1998 | |
| JP | 2001-519300 | A | 10/2001 | |
| JP | 2003-146359 | | 5/2003 | |
| JP | 2015-048088 | | 3/2005 | |
| KR | 10-2005-0051616 | A | 6/2005 | |
| WO | WO 93/21083 | | 10/1993 | |
| WO | WO 93/25439 | A1 | 12/1993 | |
| WO | WO 94/22738 | A1 | 10/1994 | |
| WO | WO 96/26128 | A1 | 8/1996 | |
| WO | WO-2008058294 | A1 * | 5/2008 | ..... B65D 71/16 |
| WO | WO 2010/006629 | A1 | 1/2010 | |

OTHER PUBLICATIONS

U.S. Appl. No. 16/426,050, filed May 30, 2019.
U.S. Appl. No. 16/426,057, filed May 30, 2019.
U.S. Appl. No. 16/426,060, filed May 30, 2019.
U.S. Appl. No. 16/426,063, filed May 30, 2019.
U.S. Appl. No. 16/426,066, filed May 30, 2019.
U.S. Appl. No. 29/692,992, filed May 30, 2019.
U.S. Appl. No. 29/692,993, filed May 30, 2019.
U.S. Appl. No. 29/692,994, filed May 30, 2019.
U.S. Appl. No. 29/692,996, filed May 30, 2019.
U.S. Appl. No. 29/692,997, filed May 30, 2019.
U.S. Appl. No. 16/598,282, filed Oct. 10, 2019.
U.S. Appl. No. 29/709,918, filed Oct. 18, 2019.
U.S. Appl. No. 16/829,346, filed Mar. 25, 2020.
U.S. Appl. No. 29/735,178, filed May 19, 2020.
U.S. Appl. No. 16/937,043, filed Jul. 23, 2020.
U.S. Appl. No. 29/739,927, filed Jun. 30, 2020.
U.S. Appl. No. 29/739,929, filed Jun. 30, 2020.
U.S. Appl. No. 29/739,931, filed Jun. 30, 2020.
U.S. Appl. No. 29/739,933, filed Jun. 30, 2020.
U.S. Appl. No. 29/739,934, filed Jun. 30, 2020.
U.S. Patent Application No. 17/118,999, filed Dec. 11, 2020.
U.S. Appl. No. 17/119,016, filed Dec. 11, 2020.
U.S. Appl. No. 17/119,040, filed Dec. 11, 2020.

* cited by examiner

CARRIER, BLANK AND METHOD FOR CONTAINERS

CROSS-REFERENCE TO RELATED APPLICATIONS

This application claims the benefit of each of U.S. Provisional Application No. 62/728,454, filed on Sep. 7, 2018, U.S. Provisional Patent Application No. 62/767,188, filed on Nov. 14, 2018, and U.S. Provisional Patent Application No. 62/770,566, filed on Nov. 21, 2018.

INCORPORATION BY REFERENCE

The disclosures of each of U.S. Provisional Application No. 62/728,454, filed on Sep. 7, 2018, U.S. Provisional Patent Application No. 62/767,188, filed on Nov. 14, 2018, and U.S. Provisional Patent Application No. 62/770,566, filed on Nov. 21, 2018, are hereby incorporated by reference for all purposes as if presented herein in its entirety. The disclosures of each of U.S. Pat. Nos. 8,387,784 and 8,096,413 are also hereby incorporated by reference for all purposes as if presented herein in their entirety.

BACKGROUND OF THE DISCLOSURE

The present disclosure generally relates to packages or cartons for holding and carrying containers.

SUMMARY OF THE DISCLOSURE

According to one aspect of the disclosure, a carrier for holding a plurality of containers comprises a central panel for engaging the plurality of containers and at least one attachment feature in the central panel that receives and holds a top portion of at least one container of the plurality of containers. The at least one attachment feature comprises an opening in the central panel, a first retention feature defining a first portion of the opening and second retention feature defining a second portion of the opening. The first retention feature comprises a first retention edge of the central panel for engaging a first portion of at least one container of the plurality of containers to at least partially attach the at least one container to the carrier. The second retention feature comprises a second retention edge of the central panel for engaging a second portion of the at least one container of the plurality of containers to at least partially attach the at least one container to the carrier. The first retention edge defines the first portion of the opening and the second retention edge defines the second portion of the opening.

According to another aspect of the disclosure, a blank for forming a carrier for holding a plurality of containers comprises a central panel and at least one attachment feature in the central panel that receives and holds a top portion of at least one container of the plurality of containers when the carrier is formed from the blank, the at least one attachment feature comprises an opening in the central panel, a first retention feature defining a first portion of the opening and second retention feature defining a second portion of the opening. The first retention feature comprises a first retention edge of the central panel for engaging a first portion of at least one container of the plurality of containers to at least partially attach the at least one container to the carrier formed from the blank. The second retention feature comprises a second retention edge of the central panel for engaging a second portion of the at least one container of the plurality of containers to at least partially attach the at least one container to the carrier formed from the blank. The first retention edge defines the first portion of the opening and the second retention edge defines the second portion of the opening.

According to another aspect of the disclosure, a method of forming a package comprises obtaining a carrier comprising a central panel and at least one attachment feature in the central panel. The at least one attachment feature comprises an opening in the central panel, a first retention feature defining a first portion of the opening and second retention feature defining a second portion of the opening. The first retention feature comprises a first retention edge of the central panel and the second retention feature comprises a second retention edge of the central panel, the first retention edge defines the first portion of the opening and the second retention edge defines the second portion of the opening. The method further comprises receiving a top portion of at least one container of the plurality of containers in the opening, and engaging the first retention edge with a first portion of the at least one container and engaging the second edge with a second portion of the at least one container to at least partially attach the at least one container to the carrier.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to constructs, sleeves, cartons, or the like, and packages for holding and displaying containers such as cans, jars, bottles, etc. The containers can be used for packaging food and beverage products, for example. The containers can be made from materials suitable in composition for packaging the particular food or beverage item, and the materials include, but are not limited to, aluminum and/or other metals, plastics such as PET, LDPE, LLDPE, HDPE, PP, PS, PVC, EVOH, and Nylon; and the like; glass; or any combination thereof.

Packages according to the present disclosure can accommodate containers of numerous different shapes. For the purpose of illustration and not for the purpose of limiting the scope of the disclosure, the following detailed description describes beverage containers (e.g., generally cylindrical containers such as aluminum cans) at least partially disposed within the package embodiments. In this specification, the terms "lower," "bottom," "upper" and "top" indicate orientations determined in relation to fully erected packages.

Figure 2:
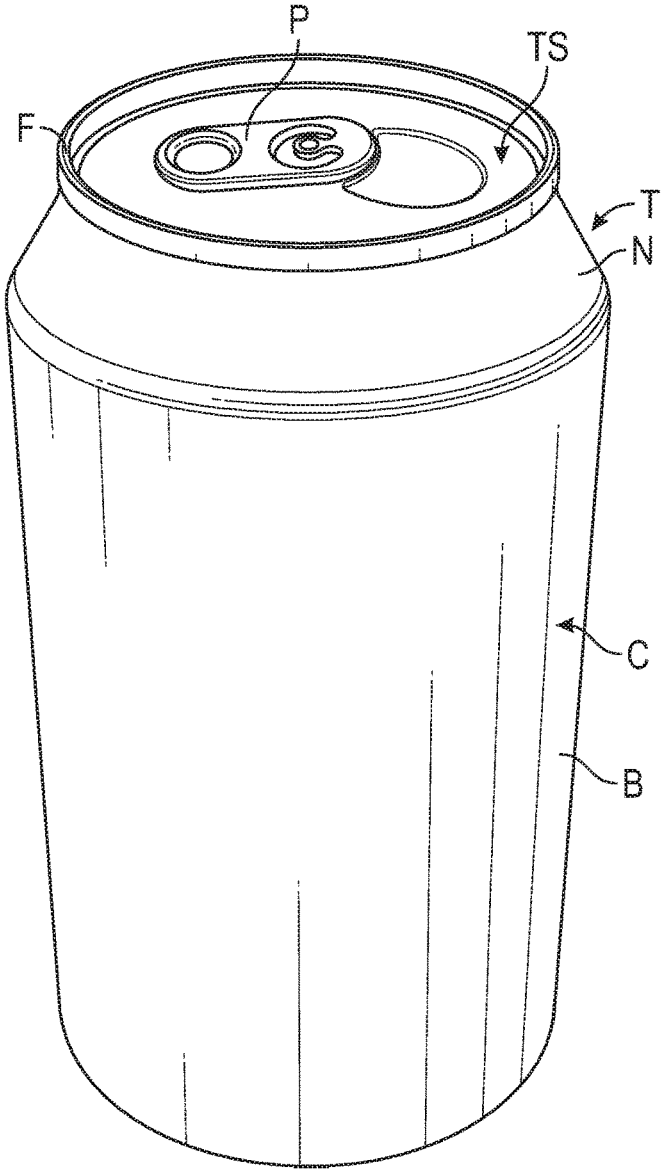
FIG. 2 is a perspective view of a container for attachment to carriers according to the present disclosure.

The present embodiments are addressed to cartons or packages for attachment to and accommodation of containers. A package or carrier 5 of a first embodiment is illustrated in its erected state in FIG. 4, in which it is attached to containers C arranged in two rows of three containers C to form a package 6. As shown in FIG. 2, the containers C are illustrated as beverage containers having a lower base portion B, a top portion T generally comprising a neck N that tapers inwardly from the lower base portion, a flange portion F at the top of the neck portion that extends radially outward from the neck portion, and a top surface TS below the flange portion that includes a pull-tab P. Containers of other sizes, shapes, and configurations, may be held in the package 5 without departing from the disclosure. The neck N and flange F of the containers C are received in respective openings 37 (broadly, respective "first attachment feature") in the package 5 and retained in the package by retaining features described further herein. The containers C could be arranged in other than a 2×3 arrangement (e.g., 2×4, 2×6, 1×3, 1×4, etc.) and the package 5 could include more or less than six containers without departing from the disclosure.

Figure 1:
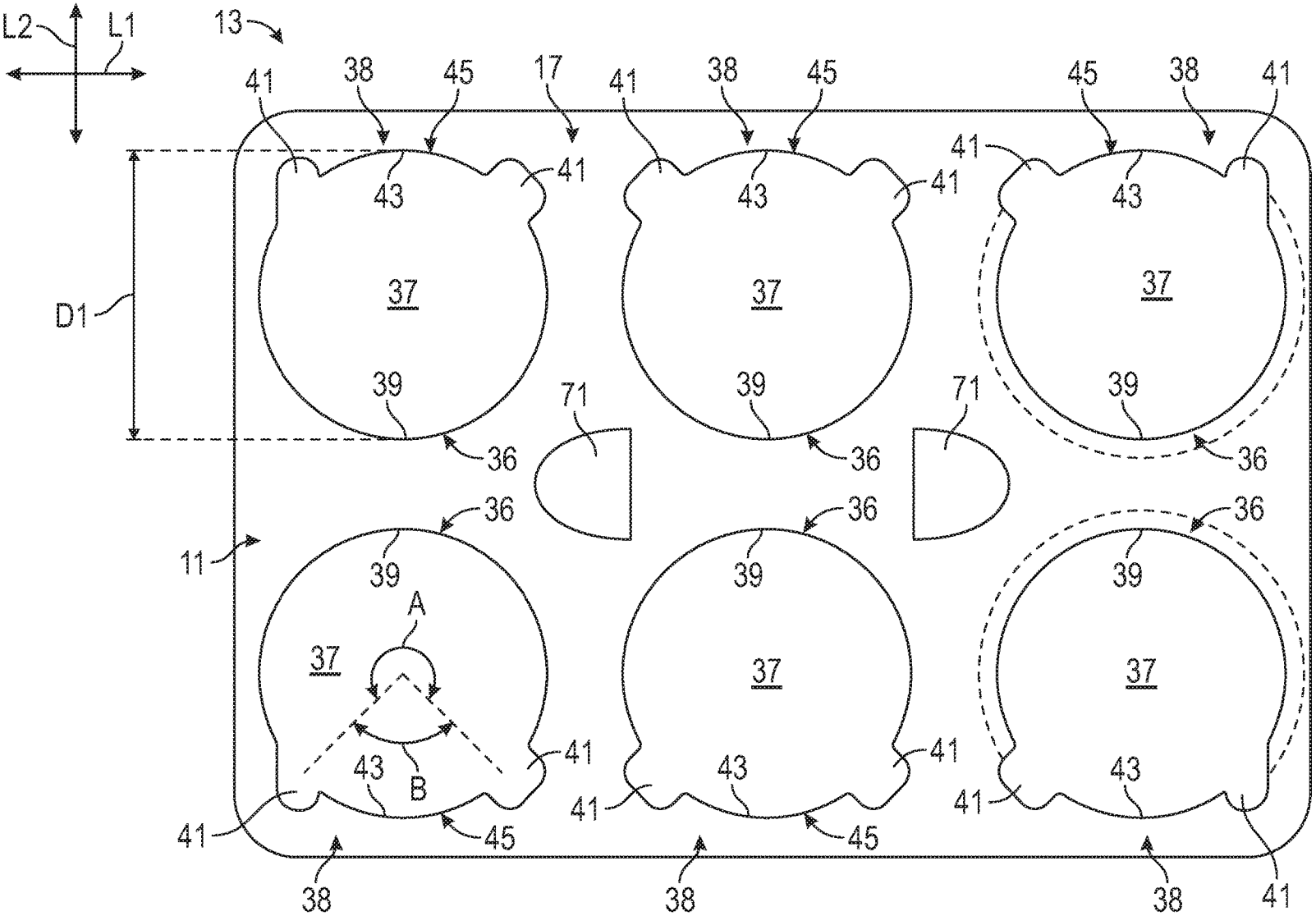
FIG. 1 is a plan view of a blank for forming a carrier according to a first exemplary embodiment of the disclosure.

FIG. 1 is a plan view of a first side 11 of a blank 13 used to form the carrier 5. The blank 13 has a longitudinal axis L1 and a lateral axis L2. The blank 13 comprises a top or central panel 17 that includes retention features. In the illustrated embodiment, the attachment features include six openings 37 in the central panel 17, each having a first retention feature that includes a first curved retention edge 39 extending between two flexible features, and a second retention feature that includes a second curved retention edge 43 opposite the first retention edge 39 and extending between the two flexible features and such that the first retention edge 39 defines a first portion of the opening 37 and such that the second retention edge 43 defines a second portion of the opening 37. As described herein the first retention edge 39 and the second retention edge 43 are for engaging a respective first portion and second portion of a container C, for example, diametrically opposed regions of a neck N below a flange F.

The retention edges 39, 43 can define respective radii of curvature that are substantially the same or equal, or, as described further herein, the retention edges 39, 43 can define different radii of curvature. In one embodiment, the openings 37 in the central panel 17 have a diameter D1 that is less than the diameter D2 of the flange F of the container C.

In the illustrated embodiment, the flexible features are part of the attachment features of the blank 13 and include a first cutout 41 and a second cutout 41 (broadly, respective "first flexible feature" and "second flexible feature") spaced apart from each other around the perimeter of the opening 37 that provide respective areas of weakening extending inwardly from the retention edges 39, 43. As shown, the cutouts 41 are areas of weakening that can have a generally U-shaped configuration, either in an elongate configuration or an irregular configuration, but the cutouts 41 could be otherwise shaped, arranged, and/or configured without departing from the disclosure.

Figure 1A:
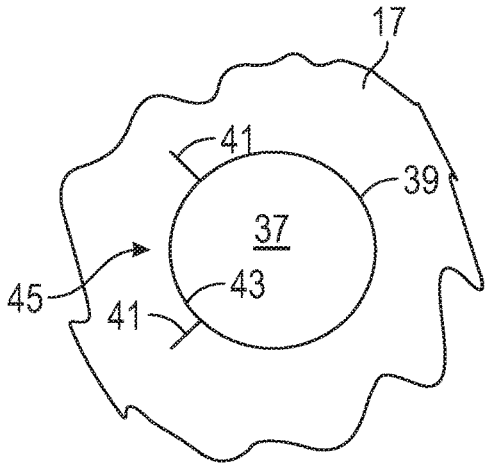
FIG. 1A is a plan view of an alternative embodiment of an opening in the blank of FIG. 1.

Referring additionally to FIG. 1A, an alternative configuration of the cutouts 41 at an opening 37 is illustrated as a generally linear tear line or cut line. In alternative embodiments, the flexible features can have any suitable configuration, for example, slits, openings, apertures, tears, fold lines, or any other line of weakening, or any other area of weakening without departing from the disclosure.

The cutouts 41 are spaced apart by an angle B and the retention edge 39 extends around the opening 37 by an angle A. In one embodiment, the angle B can be approximately 90 degrees and the angle A can be approximately 270 degrees, but both angle A and angle B could be more or less than the amounts shown and described herein without departing from the disclosure. In alternative embodiments, one or more of the openings 37 can be free of the cutouts 41 such that the retention edges 39, 43 intersect and are free from any cut, tear, or other weakening feature extending therefrom, i.e., making the angle A equal to 360 degrees. In one embodiment, such openings free of cutouts 41 could have a diameter D1 that is less than the diameter D2 of the flange F of the containers C.

As shown, a first uninterrupted marginal portion 36 of the central panel 17 extends horizontally away from the first retention edge 39 and from the first cutout 41 to the second cutout 41, and a second uninterrupted marginal portion 38 of the central panel 17 extends horizontally away from the second retention edge 43 and from the first cutout 41 to the second cutout 41. The second retention edge 43 and the cutouts 41 form a locking flap or locking tab 45 on a portion of the second uninterrupted marginal portion 38 of the central panel 17 between the first cutout 41 and the second cutout 42.

It will be understood that the shape and geometry of the edges 39, 43, or of other retention features of the blank 13/carrier 5, could vary to increase the retention forces applied to the container C and/or to accommodate various sizes and configurations of containers, without departing from the scope of the disclosure.

Figure 3:
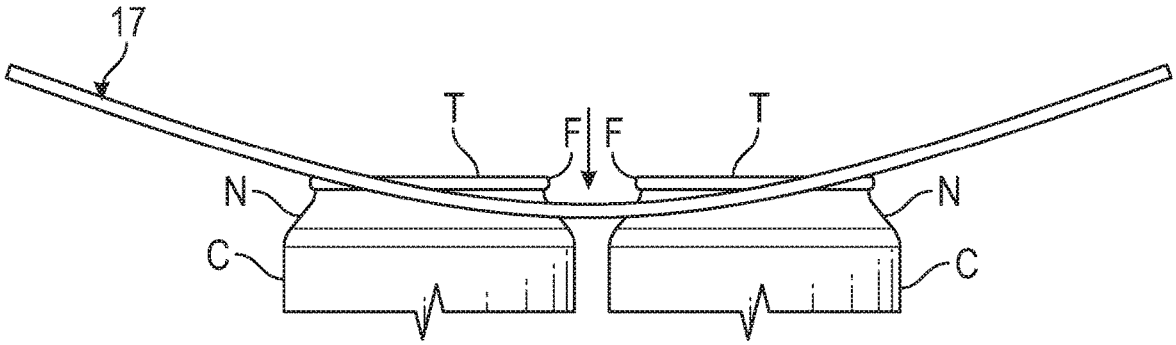
FIG. 3 is a side view of the attachment of a carrier formed from the blank of FIG. 1 onto a plurality of containers.
Figure 4:
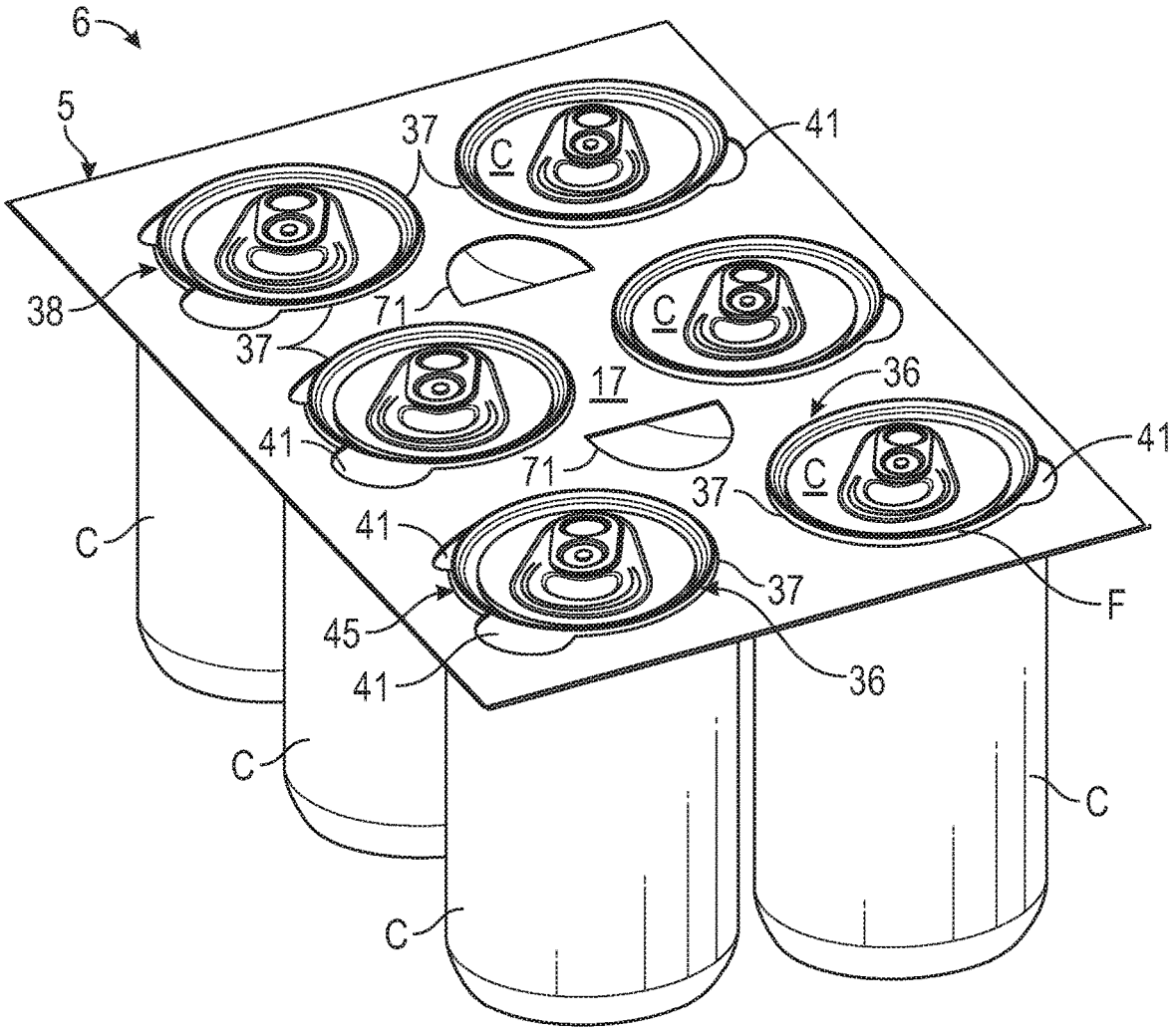
FIG. 4 is a perspective view of a package including the carrier of FIG. 3 and a plurality of containers.
Figure 5:
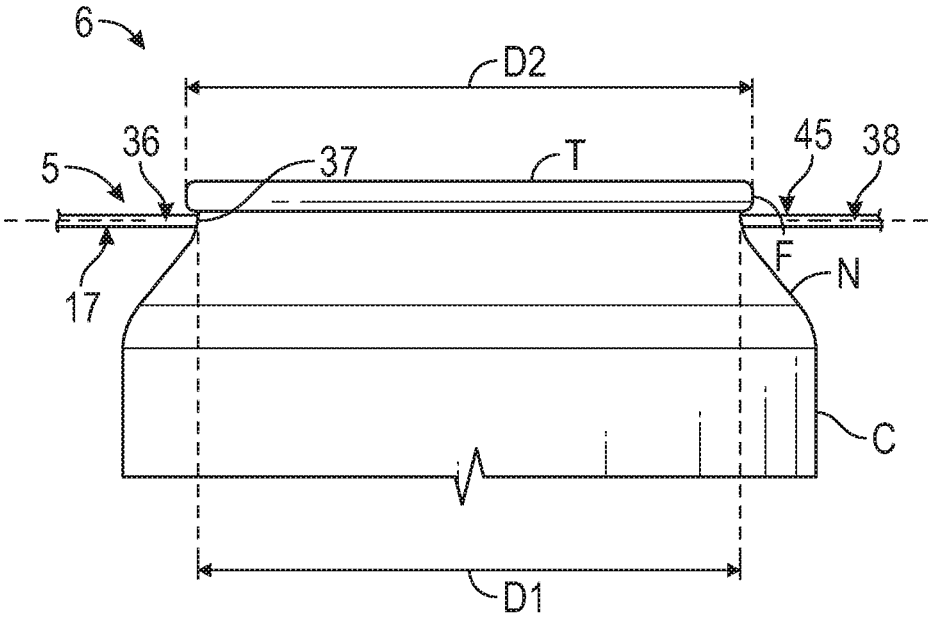
FIG. 5 is a schematic cross-sectional view of a portion of the package of FIG. 4.

Still referring to FIG. 1, and referring additionally to FIGS. 3-5, in one embodiment, a method of forming a package 6 that includes the carrier 5 and one or more of the containers C comprises obtaining the blank 13 and obtaining the group of containers C (e.g., six containers, but more or less than six containers can be included in the package 6). The blank 13 is positioned on top of the group of containers C and the central panel 17 of the blank 13 is pushed downward so that the flanges F of the containers are inserted through a respective opening 37. The diameter D1 of the openings 37 is less than the diameter D2 of the flange F of the containers C so that the central panel 17 can flex or distorts, as shown in FIG. 3, without delaminating, damaging, or otherwise weakening the material of the blank 13/central panel 17 when the flanges F are inserted through the openings 37. After pressing the blank 13 downward onto the containers C, the retention edges 39, 43 of the respective openings 37 contact a respective container C at the neck portion N of the container C below the flange F, as shown in FIG. 5.

Figure 26:
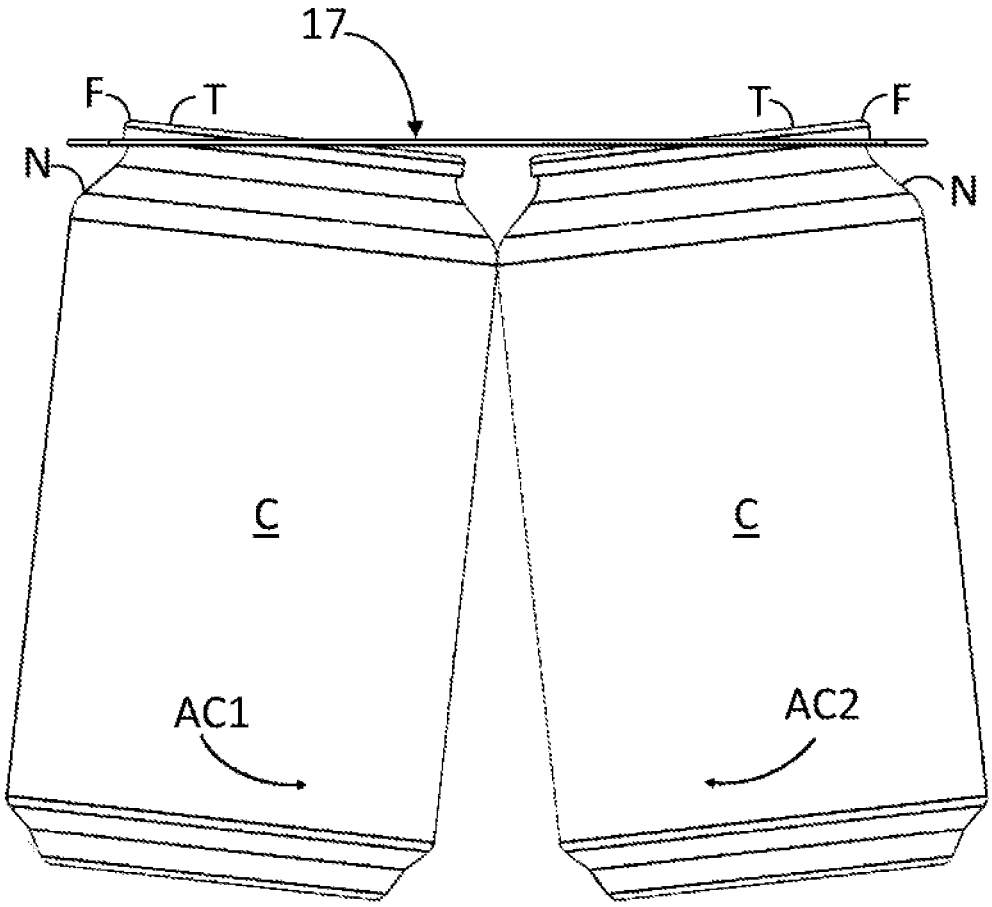
FIG. 26 is a side view of an alternative attachment of a carrier formed from the blank of FIG. 1 onto a plurality of containers.

Referring to FIG. 26, the containers C can be tilted or reoriented relative to the blank 13 to facilitate attachment of the central panel 17 and the containers C. As shown, the containers C can be tilted toward the center of the central panel 17 and at least partially inserted through the openings 37. Thereafter, the lower base portions B of the containers C can be pivoted in the direction of the respective arrows AC1, AC2 until the containers C are in a generally upright orientation extending at least partially through the openings, with the central panel 17 positioned with the neck portion N of the respective containers C below the respective flanges F. The above-described insertion of the containers C through the respective openings 37 and pivoting action of the containers facilitates a gentle and relaxed engagement of the top portions T of the respective containers C with the portions of the central panel 17 surrounding the respective openings 37, e.g., the marginal portions 36, 38 and the retention tab 45, for example, so as to minimize flexing, stretching, or other reconfiguration of the board/material that forms the central panel 17.

With regard to the embodiment described above in which the openings 37 are free from cutouts 41, the paperboard that forms the blank 13/carrier 5 can flex and stretch when such openings are placed over the flanges F of the containers C, and may tear and/or weaken at one or more points around a 360 degree edge of the openings 37 to allow the flange F to fit through a respective opening 37 and allow the central panel 17 to be positioned below the flange F with the surrounding uninterrupted marginal portion of the central panel 17 positioned to be generally horizontally and in contact with the neck N of the containers C.

Referring to FIG. 5, the marginal portions 36, 38 of the central panel 17 that extend around the respective openings 37 between the respective cutouts 41 comprise a continuous portion of board/material of the central panel 17 that is free from folds, cuts, tears, or other forms of weakening such that the marginal portions 36, 38 have enhanced strength properties, thus resulting in stronger attachment of the containers C to the package 6. In this regard, when the containers C are attached to the central panel 17, the marginal portion 36 of the central panel 17 and the marginal portion 38/retention tab 45 are positioned in an approximately horizontal and coplanar arrangement relative to the remainder of the top panel 17 to contact the containers C at opposed surfaces of the neck N below the flange F. Once the containers C are placed into the openings 37 and secured to the central panel 17, the package 6 can be grasped and carried at one or both of the handle openings 71.

In one embodiment, the flanges F of the containers C can have a diameter D2 of approximately 53 mm and the openings 37 in the central panel 17 can have a diameter D1 of approximately 52 mm. In one embodiment, the cutouts 41 can be spaced apart around the openings 37 by an angle B of approximately 90 degrees and the uninterrupted marginal portion 36 of the board at the edge 39 of the opening 37 extends around the opening by an angle A of approximately 270 degrees between the cutouts 41.

The blank 13 can have features that are otherwise shaped, configured, dimensioned, and/or positioned without departing from the disclosure. All dimensional information presented herein is illustrative of an exemplary embodiment of the disclosure and is not intended to limit the scope of the disclosure as any dimension presented herein can be more or less than the specific dimensions disclosed herein.

In addition, the marginal portion 36 of the central panel 17 at the respective edges 39 of a pair of the openings 37 is illustrated schematically as having a boundary (shown in dashed lines) for illustrative purposes only, as the uninterrupted portion of the board of the central panel 17 would extend beyond the illustrated boundary of the marginal portion 36 as illustrated. In other embodiments of the disclosure, the marginal portions 36 adjacent the respective openings 37 could include a coating, a polymer film, adhesive tape, or other strengthening or reinforcing feature to further strengthen the board in this area of the central panel 17 that is in contact with the containers C and is adjacent the openings 37.

Figure 6:
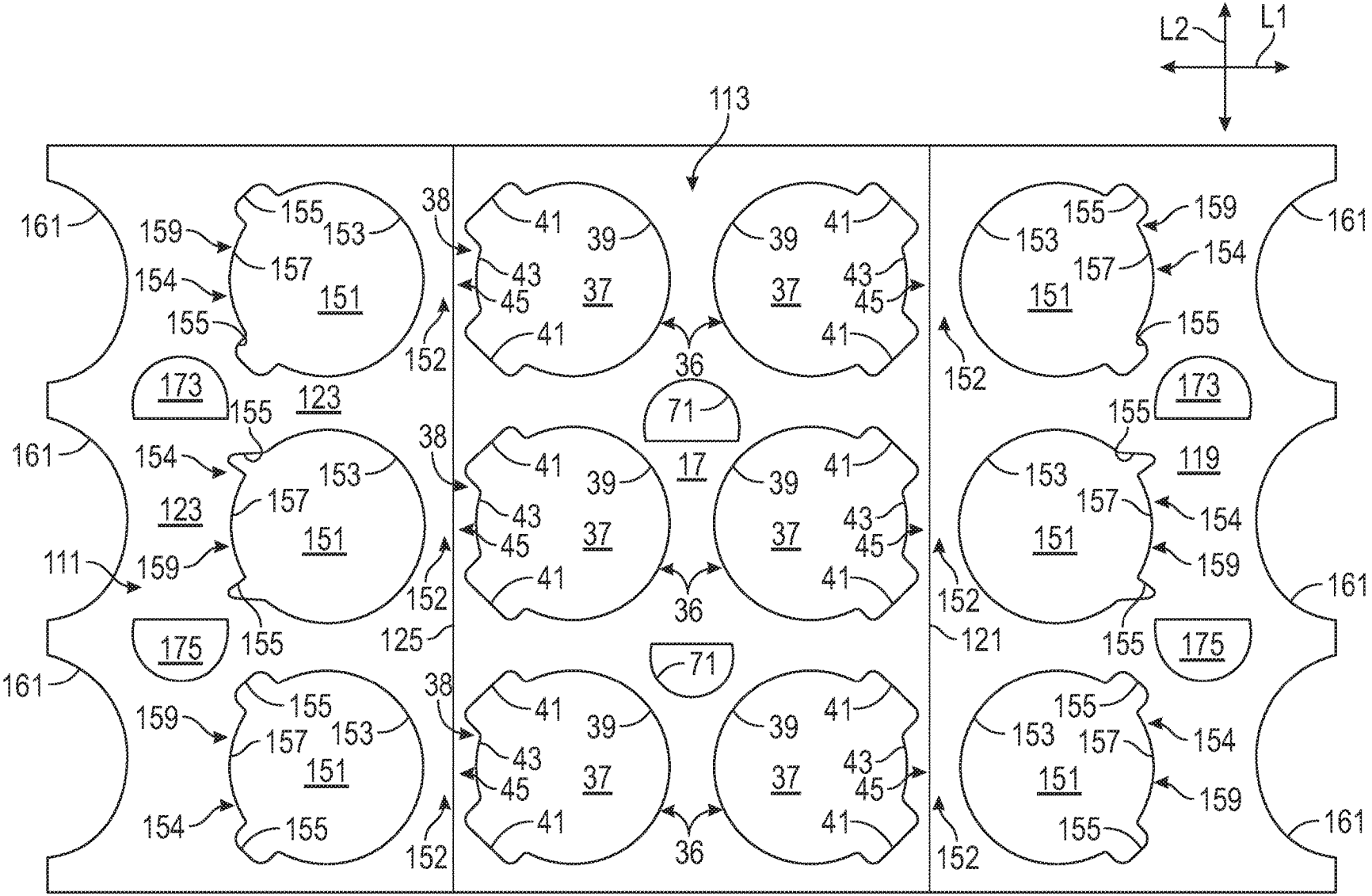
FIG. 6 is a plan view of a blank for forming a carrier according to a second exemplary embodiment of the disclosure.

FIG. 6 is a plan view of a first side 111 of a blank 113 used to form a carrier 105 and a package 106 that includes the carrier 105 and one or more container C, according to a second exemplary embodiment of the disclosure. The blank 113/carrier 105 can have one or more features that are substantially similar or the same as those described above with respect to the blank 13/carrier 5, and like or similar features are referenced with like or similar numerals.

The blank 113 has the longitudinal axis L1 and the lateral axis L2 and comprises the top panel 17 foldably connected to a first retention flap 119 at a first lateral fold line 121. The central panel 17 is foldably connected to a second retention flap 123 at a second lateral fold line 125.

In the embodiment of FIG. 6, the central panel 17 includes the six openings 37 each having the associated respective cutouts 41, retention edges 39 43, marginal portions 36, 38, and locking tabs 45. As shown, the respective tabs 45 are generally adjacent a respective lateral fold line 121, 125.

Similarly, the first retention flap 119 and second retention flap 123 each have three openings 151 (broadly, respective "second attachment feature") that are shaped similarly to the openings 37. The openings 151 are at least partially defined by a third retention feature that includes a first curved retention edge 153 defining a first portion of the opening 151 and extending between two flexible features (broadly, respective "first flexible feature" and "second flexible feature"), and a fourth retention feature that includes a second curved retention edge 157 defining a second portion of the opening 151 and extending between the flexible features. The retention edges 153, 157 are for engaging the respective first and second portions of a container C, as described above.

As described above, the flexible features include respective areas of weakening extending inward from the retention edges 153, 157 to allow the respective retention flaps 119, 123 to flex or bend without weakening when containers C are inserted into the respective openings 151. The flexible features can be cutouts 155, as shown, or can have a different configuration as described above with respect to the cutouts 41.

The third retention feature can also include a first uninterrupted marginal portion 152 of the respective retention flaps 119, 123 extends horizontally away from the respective first retention edge 153 and the fourth retention feature can also include a second uninterrupted marginal portion 154 of the respective retention flaps 119, 123 extends horizontally away from the respective second retention edge 157. The second retention edges 157 and the cutouts 155 form a respective locking flap or locking tab 159 between the respective cutouts 155 on a portion of the respective second uninterrupted marginal portion 154 of the retention flaps 119, 123.

In the illustrated embodiment, the first retention flap 119 and the second retention flap 123 each have three notches 161 (broadly, "second attachment feature") at the respective peripheral edge 163, 165 of the respective retention flap 119, 123. In one embodiment, the openings 151 in the retention flaps 119, 123 are shaped to have smaller cutouts 155 than the cutouts 41 of the openings 37 in the central panel 17. As such, the smaller cutouts 155 form a larger locking flap 159 than the locking flaps 45 adjacent the openings 37 in the central panel 17. It will be understood that the shape and geometry of the edges 39, 43, 157, 153, or other features, could vary to increase the retention forces applied to the container C and/or to accommodate various sizes and configurations of containers, without departing from the scope of the disclosure.

As also shown, the retention flaps 119, 123 each include respective handle openings 173, 175 that are separably connected to the retention flaps 119, 123 and can be foldably connected thereto, and which align with the respective handle openings 71 in the central panel 17 upon formation of the carrier 5 to form a handle 109 of the carrier 105.

The features of the blank 113 could be otherwise shaped, arranged, and/or configured without departing from the disclosure.

Figure 7:
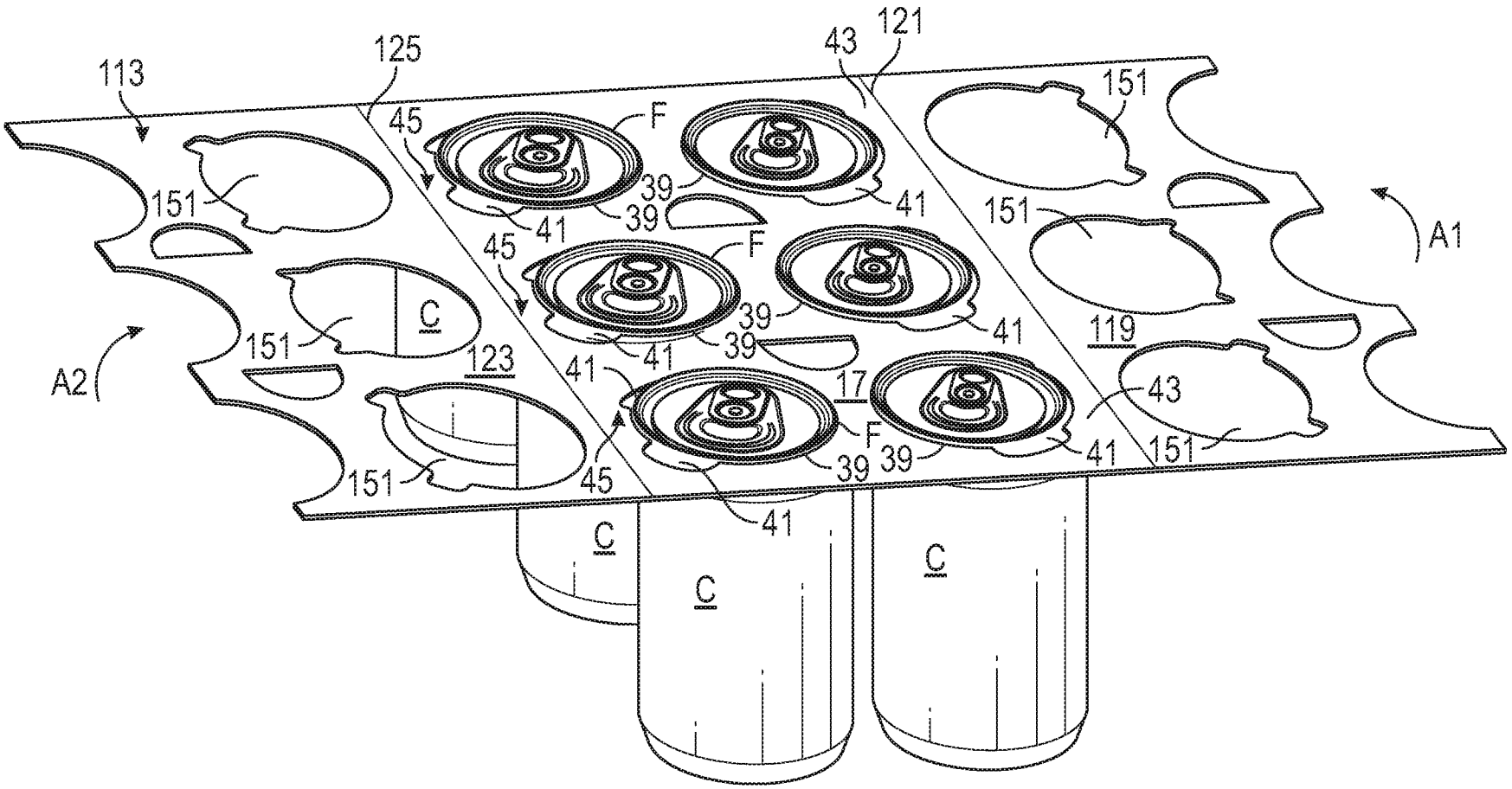
FIG. 7 is a perspective view of a partially folded configuration of the blank of FIG. 6.
Figure 8:
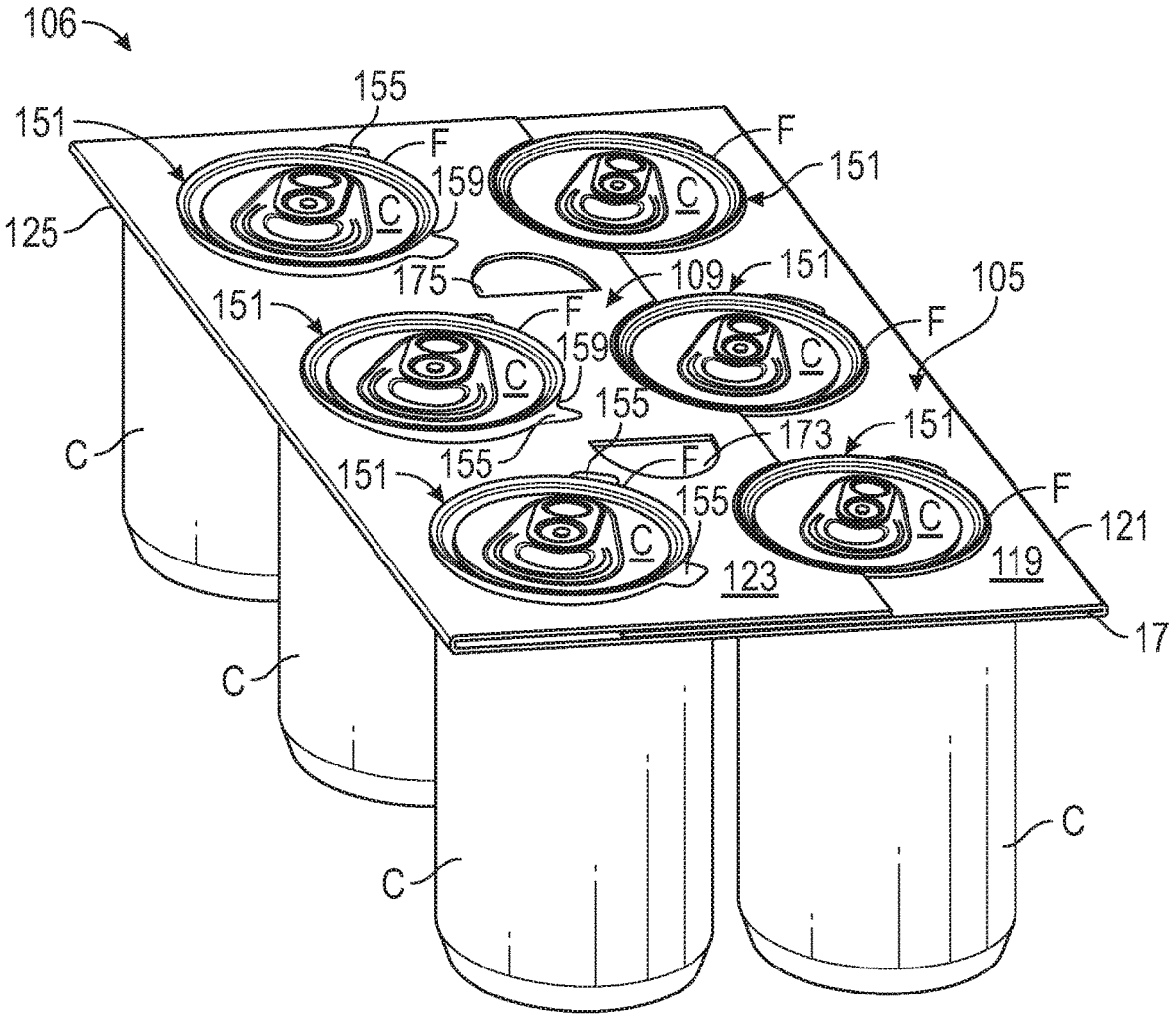
FIG. 8 is a perspective view a package including a carrier formed from the blank of FIG. 6 and a plurality of containers.
Figure 9:
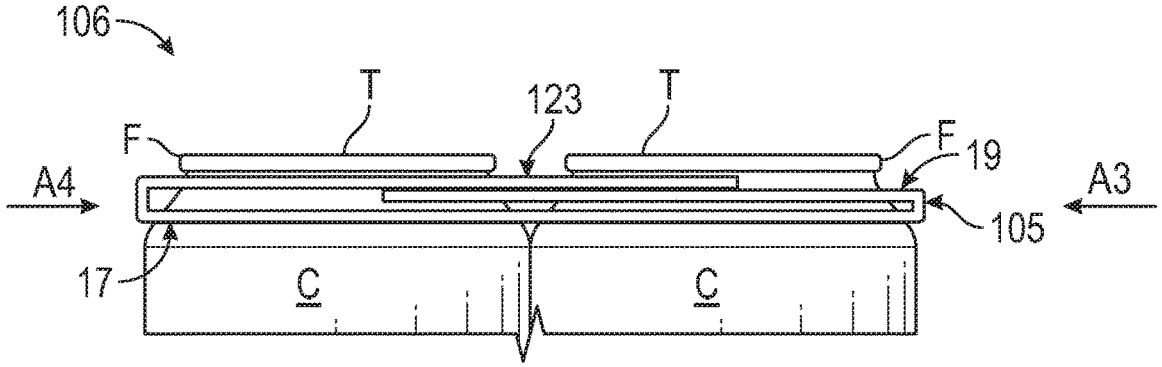
FIG. 9 is a side view of a portion of the package of FIG. 8.

FIGS. 7-9 illustrate various steps for forming the package 106 that includes the carrier 105 and one or more containers C in accordance with one exemplary method of the disclosure. The central panel 17 of the blank 113 is first attached to the containers C so that the surface of the central panel 17 is below or in contact with the bottom surface of the flanges F of the containers C.

Thereafter, the first retention flap 119 is folded about fold line 121 in the direction of the arrow A1 so that the openings 151 of the first retention flap 119 are placed on top of the three containers C in one row of the containers C, with the first retention flap 119 being pressed into face-to-face contact with the central panel 17 so that the surface of the first retention flap 119 is below or in contact with the bottom surface of the flanges F of the containers C. Next, the second retention flap 123 is folded about fold line 125 in the direction of the arrow A2 so that the openings 151 of the second retention flap 123 are placed on top of the three containers C in the other row of containers C, with the second retention flap 123 being pressed into face-to-face contact with the central panel 17 so that the surface of the retention flap 123 is below or in contact with the bottom surface of the flanges F of the containers C. In addition, the respective notches 161 defined along the free edges of the respective retention flaps 119, 123 can also rest against and/or at least partially engage the bottom surfaces of the flanges F of the respective containers C. Such additional layer of material provided by the portion of the respective retention flaps 119, 123 can enhance the engagement of the carrier 105 with the containers C. In one embodiment, an outer marginal portion of the second retention flap 123 can overlap and be in face-to-face contact with an outer marginal portion of the first retention flap 119.

The respective overlapped openings 37 and 151 form secure receptacles in the carrier 105/package 106 that securely attach the containers C to the carrier 105 and that comprise at least two layers of material. The openings 37 and 151 having the respective cutouts 41, 155 and respective curved edges 39, 43, 153, 159 are shaped to facilitate receiving the circular flange F of the containers C and locking the containers C in secure engagement with the package 106. Also, the respective locking flaps 45, 159 formed between the respective cutouts 41, 155 are free from any cuts or tears in the central panel 17 and the retention flaps 119, 123 so that the biasing force of the retention flaps 119, 123 applied to the containers C is increased. The direction of such biasing forces are schematically illustrated with respective arrows A3, A4 in FIG. 9. The carrier 105/package 106 can be lifted at the handle 9 and carried such that all six of the containers C are secured to the carrier 105/package 106 and can be lifted by grasping and carrying at the handle 109.

Glue or other adhesive can be applied to one or more of the panels and/or flaps of the blank 113 to secure the carrier 105 in the folded condition. Further, the carrier 105 could include dispensing features for facilitating removal of the containers C therefrom. The blank 113 could be otherwise shaped and/or arranged and the carrier 105 could have features that are otherwise shaped and/or arranged without departing from the disclosure. In additional embodiments, the blank 113 could have panels or flaps that extend down from the top of the containers or the flange of the containers to provide a billboard for display of information.

Figure 10:
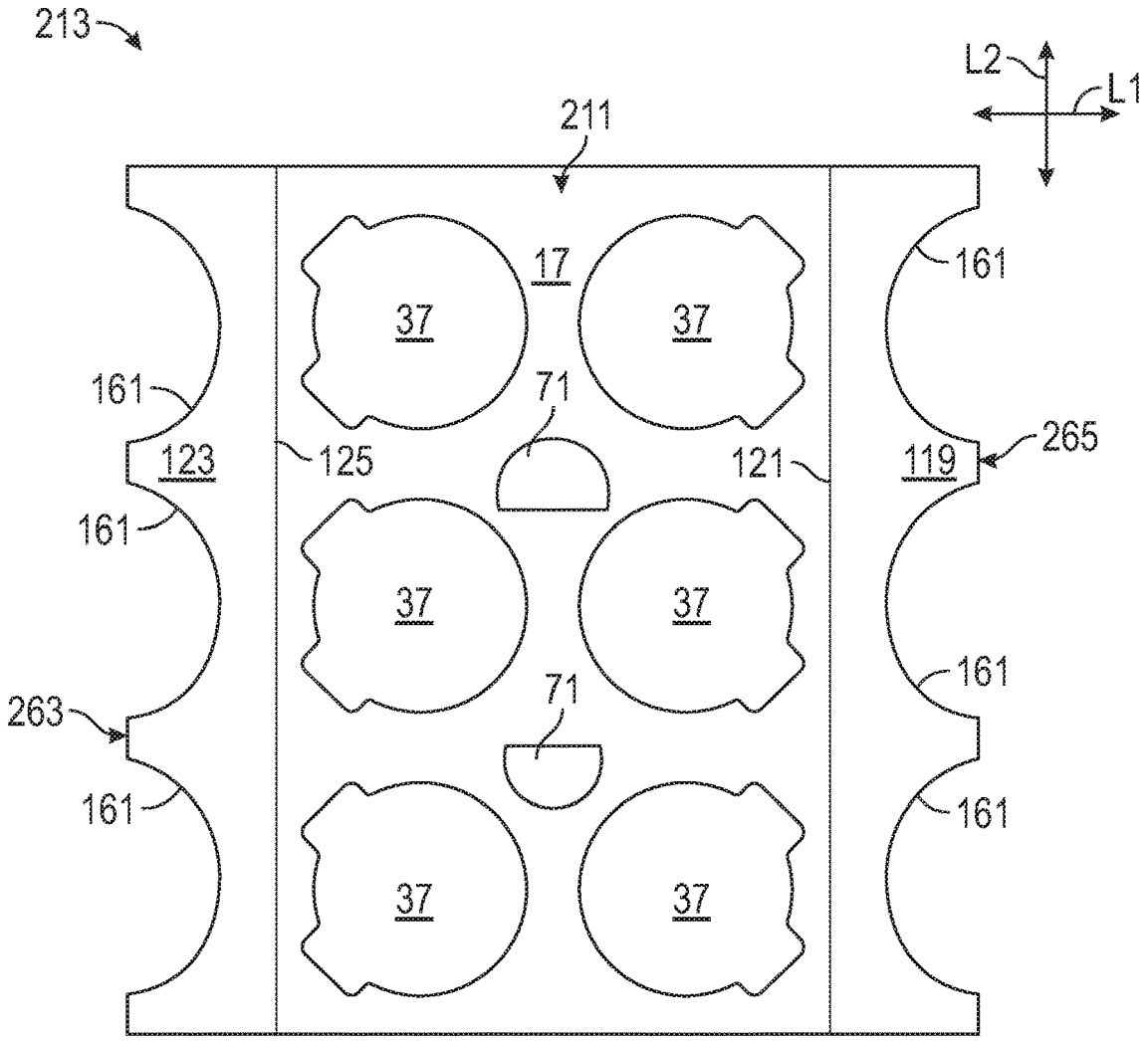
FIG. 10 is a plan view of an alternative configuration of the blank of FIG. 6.

FIG. 10 shows a first surface 211 of a blank 213 for forming a carrier 205 (FIG. 11) according to a third exemplary embodiment of the disclosure. The blank 213 and the carrier 205 can have one or more features that are substantially similar or the same as those disclosed above with respect to the blank 13/carrier 5 and the blank 113/carrier 105, and like or similar features are indicated with like or similar reference numerals.

In the embodiment of FIG. 10, the blank 213 has the lateral axis L1 and the lateral axis L2 and includes a first retention flap 119 and a second retention flap 123 that are alternatively shaped compared to the retention flaps 119, 123 of the second exemplary embodiment. The retention flaps 119, 123 include respective curved notches 261 at a respective edge 263, 265 of the retention flaps 119, 123. In such an arrangement, the retention flaps 119, 123 do not include the openings 151 of the second exemplary embodiment.

Figure 11:
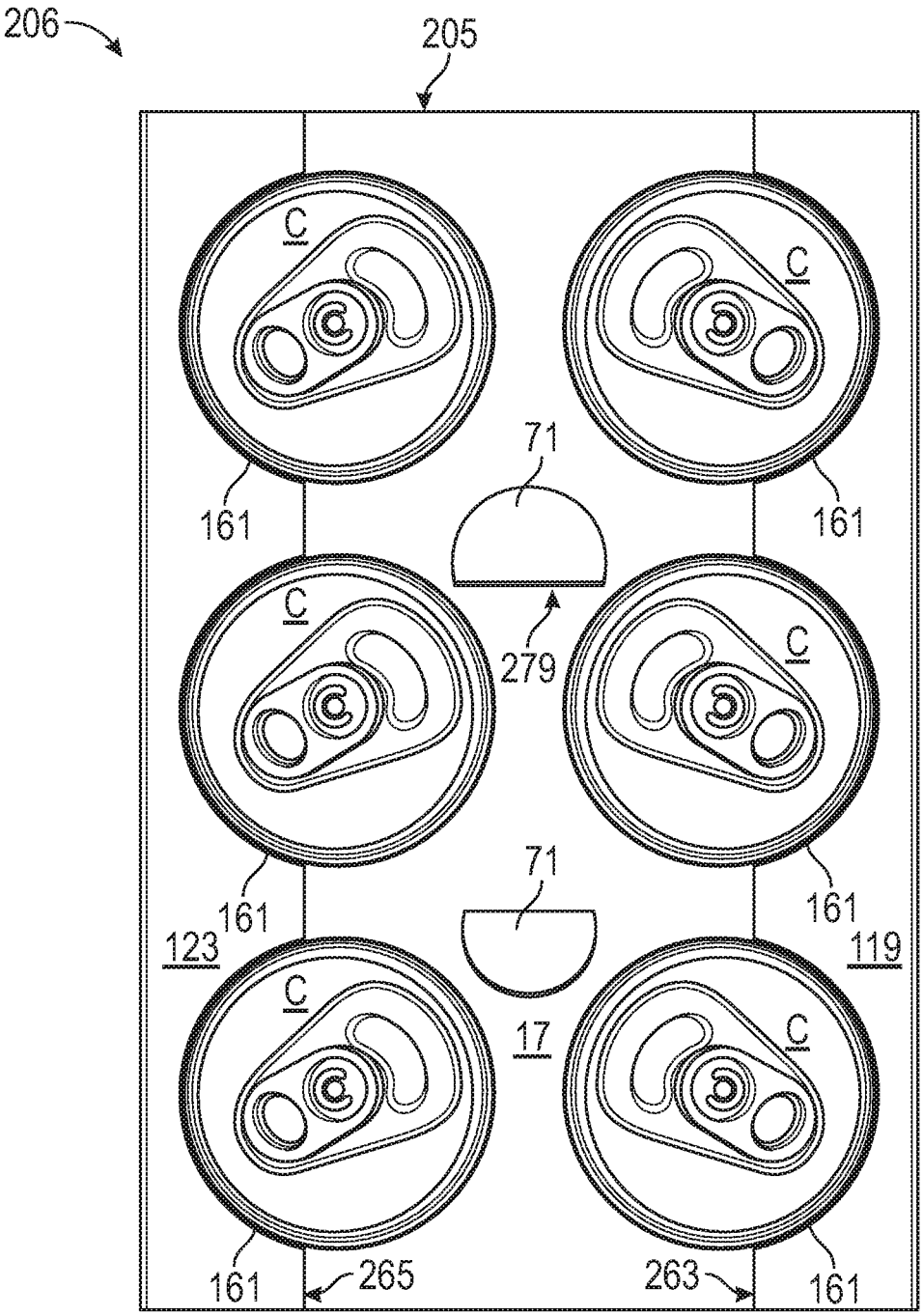
FIG. 11 is a plan view of a package including a carrier formed from the blank of FIG. 10 and a plurality of containers.

The carrier 205 of the third exemplary embodiment is formed in a similar manner as described herein for the second exemplary embodiment. In this regard, and as shown in FIG. 11, the retention flaps 119, 123 have a shorter width such that the retention flaps of the blank 213 do not overlap when the carrier 205 is formed. The features of the second embodiment could be otherwise shaped, arranged, configured and/or omitted without departing from the disclosure.

Figure 12:
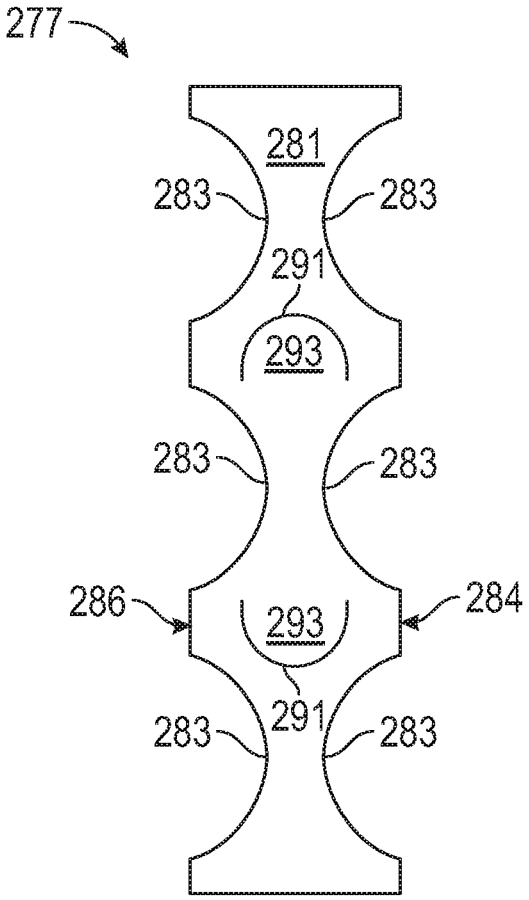
FIG. 12 is a plan view of a handle blank for forming a portion of a handle according to an exemplary embodiment of the disclosure.

Referring additionally to FIG. 12, a handle blank 277 for forming a handle 279 for the package 206 is illustrated. As shown, the handle blank 277 includes a handle panel 281 with a pair of free edges 284, 286 that define respective notches 289. A pair of arcuate cuts 291 can define handle flaps 293 in the handle panel 281.

Figure 13:
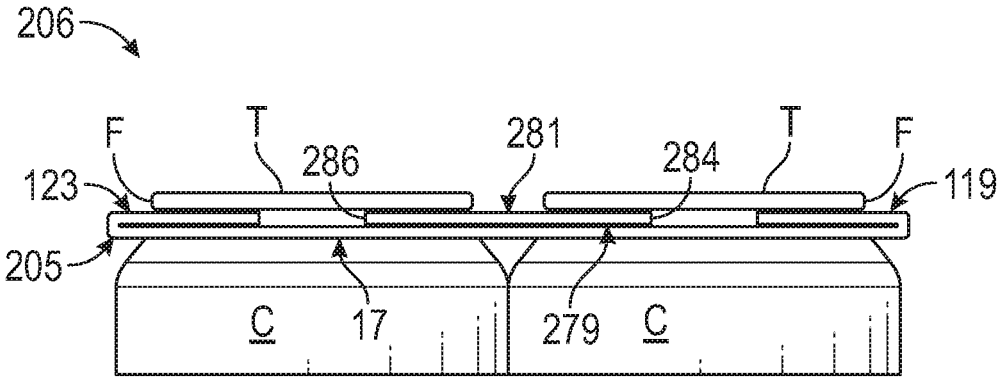
FIG. 13 is a side view of a portion of the package of FIG. 11 having the handle blank attached thereto to form a handle.

Turning to FIG. 13, the handle panel 281 can be positioned in at least partial face-to-face contact with the central panel 17 between the rows of containers C of the package 206 such that the notches 283 at least partially engage the bottom surfaces of the flanges F of the respective containers C to securely couple the handle panel 281 to the package 206. In this arrangement, the handle flaps 293 in the handle panel 281 are aligned with handle openings 71 in the central panel 17 of the carrier 205 such that a user or customer can separate the handle flaps 293 from the handle panel 281 to provide a passage for one or more of his or her fingers to provide a reinforced, e.g., two-ply, handle 279 at which a user or customer can grasp and/or carry the package 206.

Figure 14:
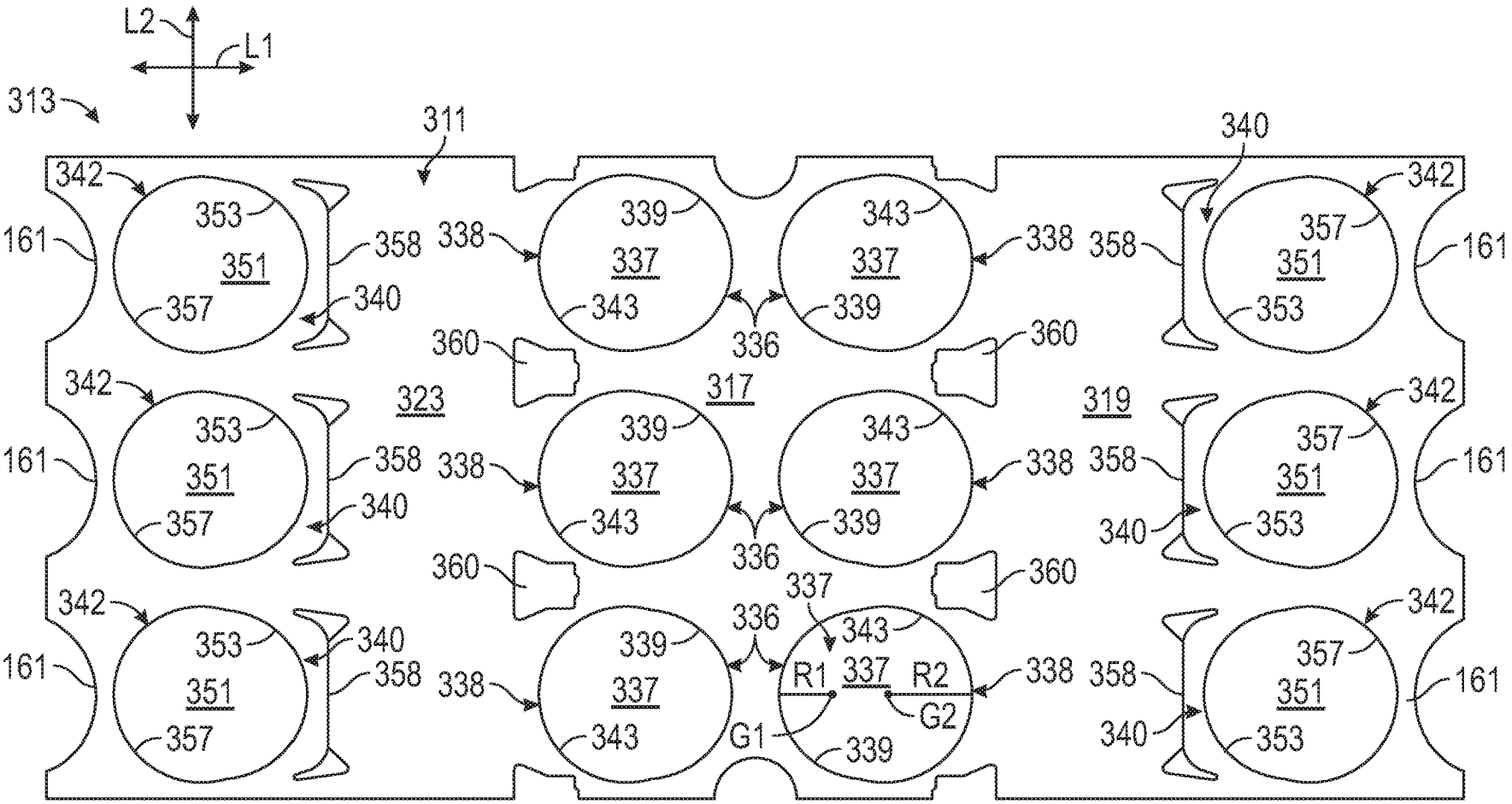
FIG. 14 is a plan view of a blank for forming a carrier according to a third exemplary embodiment of the disclosure.
Figure 15:
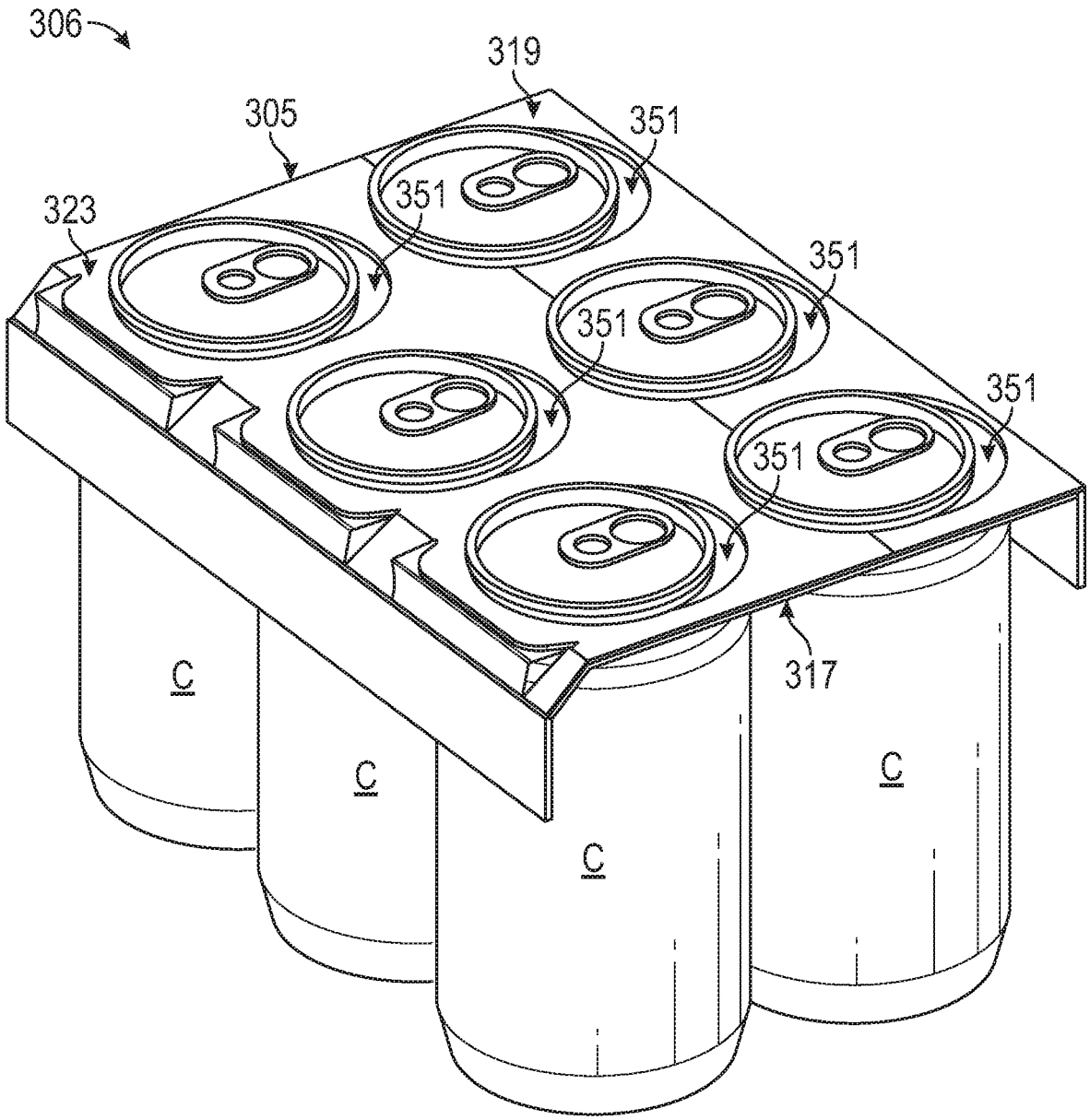
FIG. 15 is a perspective view of a package including a carrier formed from the blank of FIG. 14 and a plurality of containers.

FIG. 14 shows the first surface 311 of a blank 313 for forming a carrier 305 and a package 306 (FIG. 15) that includes the carrier 305 and one or more of the containers C, according to a fourth exemplary embodiment of the disclosure. The blank 313 and the carrier 305 can have one or more features that are substantially similar or the same as those disclosed above with respect to the blank 13/carrier 5, the blank 113/carrier 105, and the blank 213/carrier 205, and like or similar features are indicated with like or similar reference numerals.

The blank 313 has the longitudinal axis L1 and the lateral axis L2 and includes a central panel 317 having attachment features that include openings 337 (broadly, respective "first attachment feature") that are at least partially defined by first and second retention features that include a respective first curved retention edge 339 opposed with a second curved retention edge 343 that define a respective first portion and second portion of the opening 337. The first and second retention features of the central panel 317 can also include a first uninterrupted marginal portion 336 and a second uninterrupted marginal portion 338 that extend away from the respective retention edges 339, 343 of each opening 337.

Figure 16:
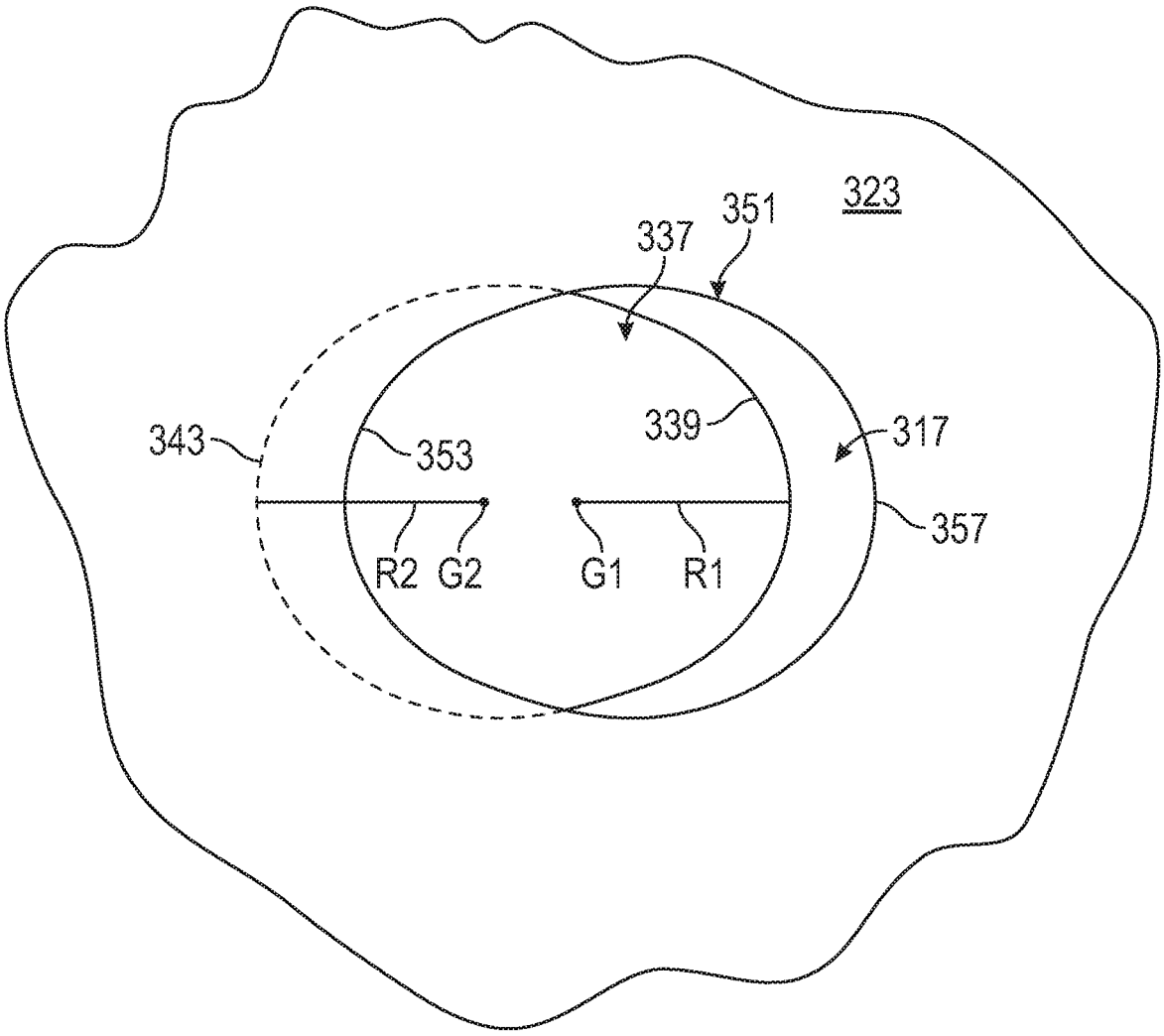
FIG. 16 is a schematic plan view of a pair of overlapped openings of the carrier of FIG. 15.

As shown in FIG. 16, the second retention edge 343 is a second arc that has a second radius of curvature R2 measured with respect to a center point G2 that is larger than a first radius of curvature R1 of a first arc formed by the first retention edge 339 that is measured with respect to a center point G1 that is longitudinally offset from the center point G2. As such, the openings 337 have an irregular shape comprising two retention edges 339, 343 that are not a continuous circle. The irregular shape of the openings 337 allow the flanges F of the containers C to be inserted into the opening 337 adjacent the second retention edge 343 having radius of curvature R2 and moved towards the first retention edge 339 to lock, e.g., compressibly engage, the container C into engagement with the central panel 317.

In this regard, the openings 337 can be characterized as "keyhole" openings as the portion of the opening 337 adjacent the second retention edge 343 is slightly larger and more receiving of the circular flange F of the container C to facilitate initial insertion therealong.

In the illustrated embodiment, the blank 313 includes respective first and second retention flaps 319, 323 that have openings 351 (broadly, respective "second attachment feature") that are shaped identical to the openings 337 in the central panel 317, in that openings 351 have third retention features and fourth retention features that include a first curved retention edge 353 corresponding to the first retention edge 339 of the openings 337, and a second curved retention edge 357 corresponding to the second retention edge 343 of the openings 337. The third and fourth retention features of the respective retention flaps 319, 323 can also include a first uninterrupted marginal portion 340 and a second uninterrupted marginal portion 340 that extend horizontally away from the respective retention edges 353, 357 of each opening 351. In one embodiment, one or both of the first and second retention flap 319, 323 could be foldably connected to the central panel 317 at a respective fold line, e.g., a lateral fold line.

The carrier 305/package 306 is formed from the blank 313 in a similar manner as described above with respect to the carrier 105/package 306 and the carrier 205/package 206, e.g., such that the top portions T of the respective containers C are at least partially received in the respective openings 337 of the central panel 317, with the retention flaps 319, 323 in overlapping face-to-face contact with each other as well as with the central panel 317. In this regard, the top portions T of the respective containers C are at least partially received through the respective overlapped openings 337, 351. In one embodiment, the retention flaps 319, 323 can be arranged so as to overlap with the central panel 317 and not with each other.

Referring additionally to FIG. 16, a top view of a portion of the assembled carrier 305 is schematically illustrated, in which an opening 351 of the retention flap 323 is overlapped with an opening 337 of the central panel 317, which together provide the "keyhole opening" described above. As shown, upon alignment of the openings 351, 337, a passage for at least partially receiving a container C is provided between the first retention edge 353 of the opening 351 of the retention flap 319 and the first retention edge 339 of the opening 337 of the central panel 317 positioned below, each of the first retention edges 353, 339 having the smaller radius of curvature R1 such that the neck portion N of a container C below the flange F is compressibly received between the first retention edges 353, 339 to secure the container C to the carrier 305. It will be understood that a container C can be secured to the carrier 305 at an opening 351 of the first retention flap 319 that is overlapped with an opening 337 of the central panel 317 in a similar manner.

It will be further understood that one or both of the openings 37, 151 described with respect to the carrier 5/package 6, the carrier 105/package 106, and the carrier 205/package 206 can have the above-described "keyhole opening" configuration described above.

The features of the blank 313 could be otherwise shaped, arranged, configured, and/or omitted without departing from the disclosure. For example, the relief cuts 358 and relief apertures 360 illustrated on the blank 313 could be differently-configured or one or more of such features could be omitted without departing from the disclosure. In additional embodiments, the blank 313 could have panels or flaps that extend down along the side of the containers C to provide a side panel or billboard for display of information, as described further herein. Also, in further embodiments, the openings 351 in the retention flaps 319, 323 could be removed such that the two retention flaps 319, 323 overlap the tops of the containers C and provide a substantially continuous, e.g., clean, flat top surface of the carrier 305/package 306.

Figure 17:
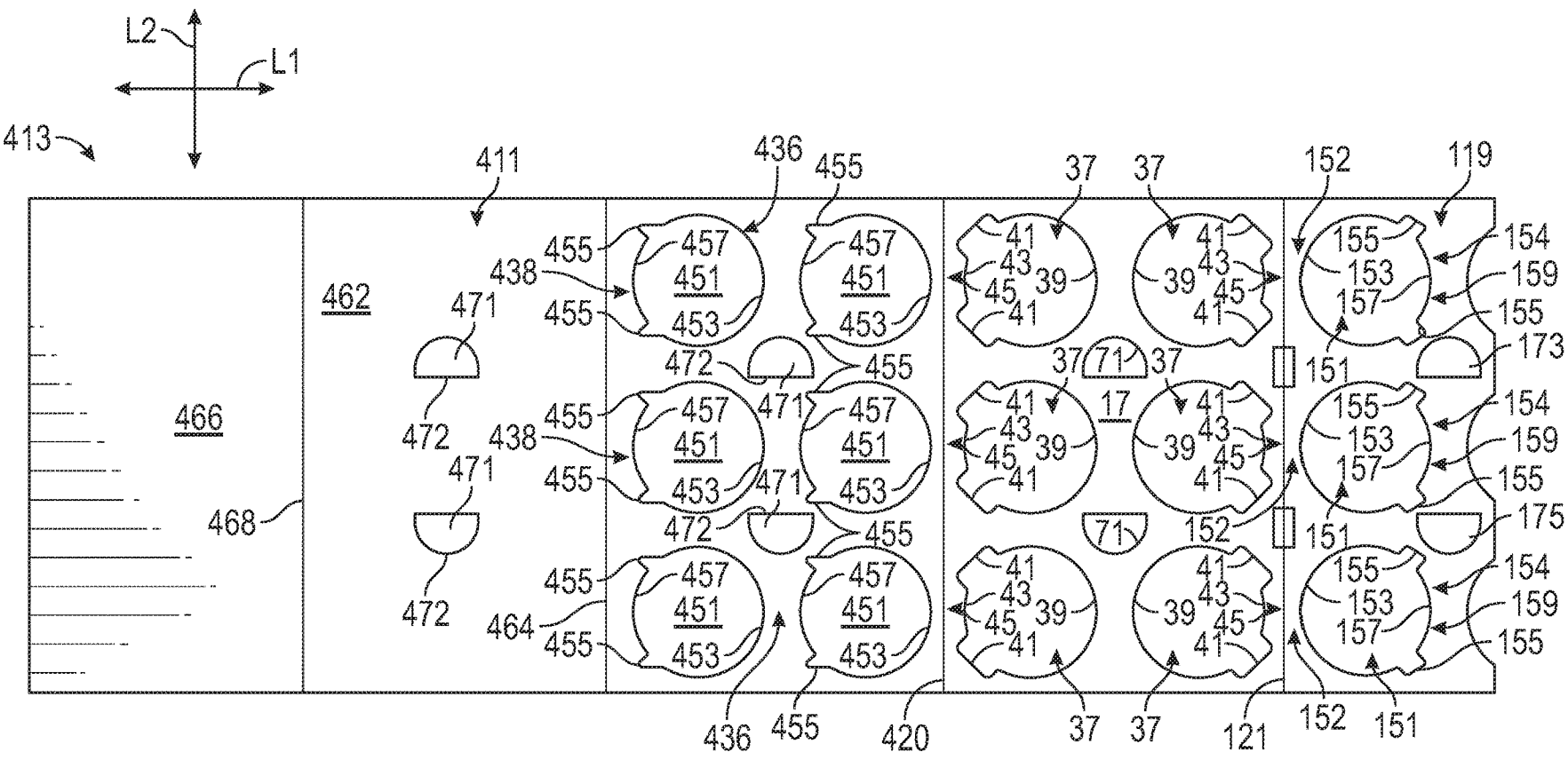
FIG. 17 is a plan view of a blank for forming a carrier according to a fourth exemplary embodiment of the disclosure.

FIG. 17 shows a first surface 411 of a blank 413 for forming a carrier 405 and a package 406 (FIG. 20) that includes the carrier 405 and one or more of the containers C, according to a fifth exemplary embodiment of the disclosure. The blank 413 and the carrier 405 can have one or more features that are substantially similar or the same as those disclosed above with respect to the blank 13/carrier 5, the blank 113/carrier 105, the blank 213/carrier 205, and the blank 313/carrier 305, and like or similar features are indicated with like or similar reference numerals.

As shown, the blank 413 has the longitudinal axis L1 and the lateral axis L2 and includes a central panel 17, a retention panel 423 foldably connected to the central panel 17 at a lateral fold line 420, and the retention flap 119 foldably connected to the central panel 17 at the lateral fold line 121. The blank 413 further includes a handle panel or top panel 462 foldably connected to the retention panel 423 at a lateral fold line 464, and a side panel or billboard 466 foldably connected to the top panel 462 at a lateral fold line 468.

The retention panel 423 can have attachment features in the form of three openings 451 (broadly, respective "second attachment feature") that are shaped similarly to the openings 37 of the central panel 17. The openings 451 include retention features, with a third retention feature including a respective first curved retention edge 453 along a first uninterrupted marginal portion 436 of the retention panel 423 and extending between two flexible features to define a first portion of the opening 451, and fourth retention feature including a second curved retention edge 457 along a second uninterrupted marginal portion 438 extending between the flexible features and defining a second portion of the opening 451. A retention tab can be defined between the flexible features along a portion of the uninterrupted marginal portion 438 as described above with respect to the retention tabs 45.

The flexible features are part of the attachment features of the blank 413 and can be cutouts 455 (broadly, respective "first flexible feature" and "second flexible feature") that include respective areas of weakening extending inward from the retention edges 453, 457, as shown, or can have a different configuration as described above.

Each of the retention panel 423 and the top panel 462 can include a pair of spaced handle flaps 471 foldably connected thereto at respective longitudinal fold line 472. As described herein, the handle flaps 471 can be aligned with each other and the handle openings 71 of the central panel 17 and the handle openings 173, 175 of the retention flap 119 upon formation of the carrier 405 to provide a handle 409 to the carrier 405/package 406.

Figure 18:
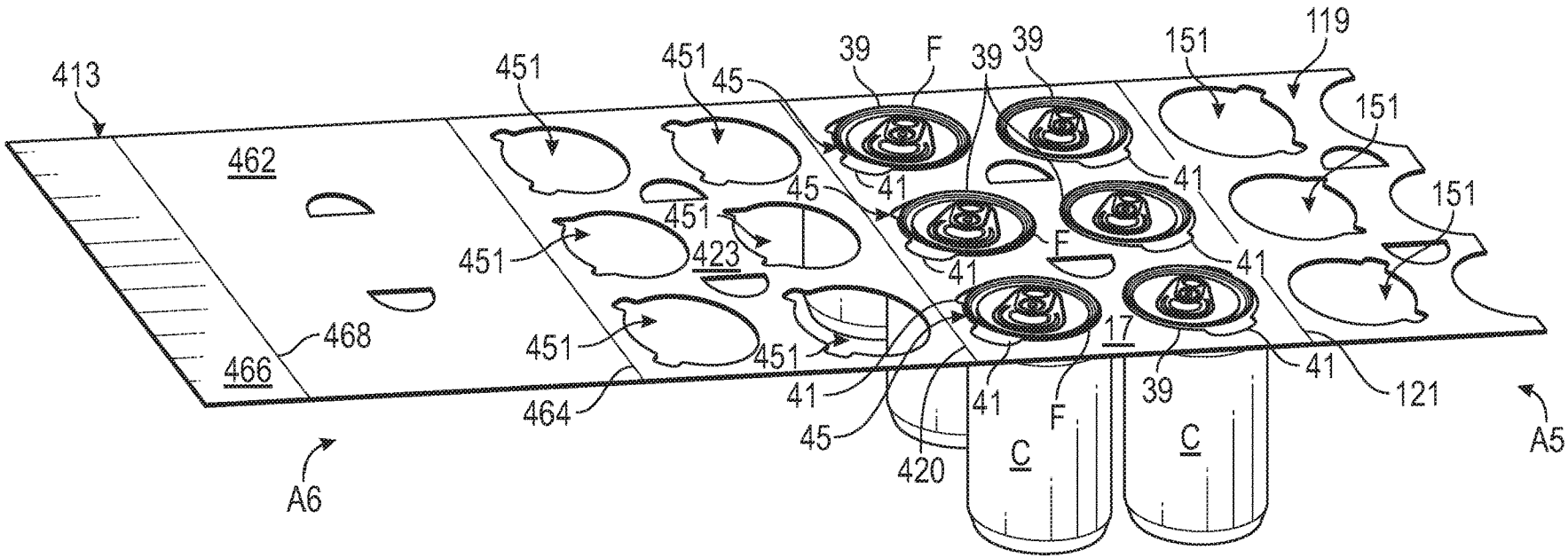
FIG. 18 is a perspective view of a partially folded configuration of the blank of FIG. 17.
Figure 19:
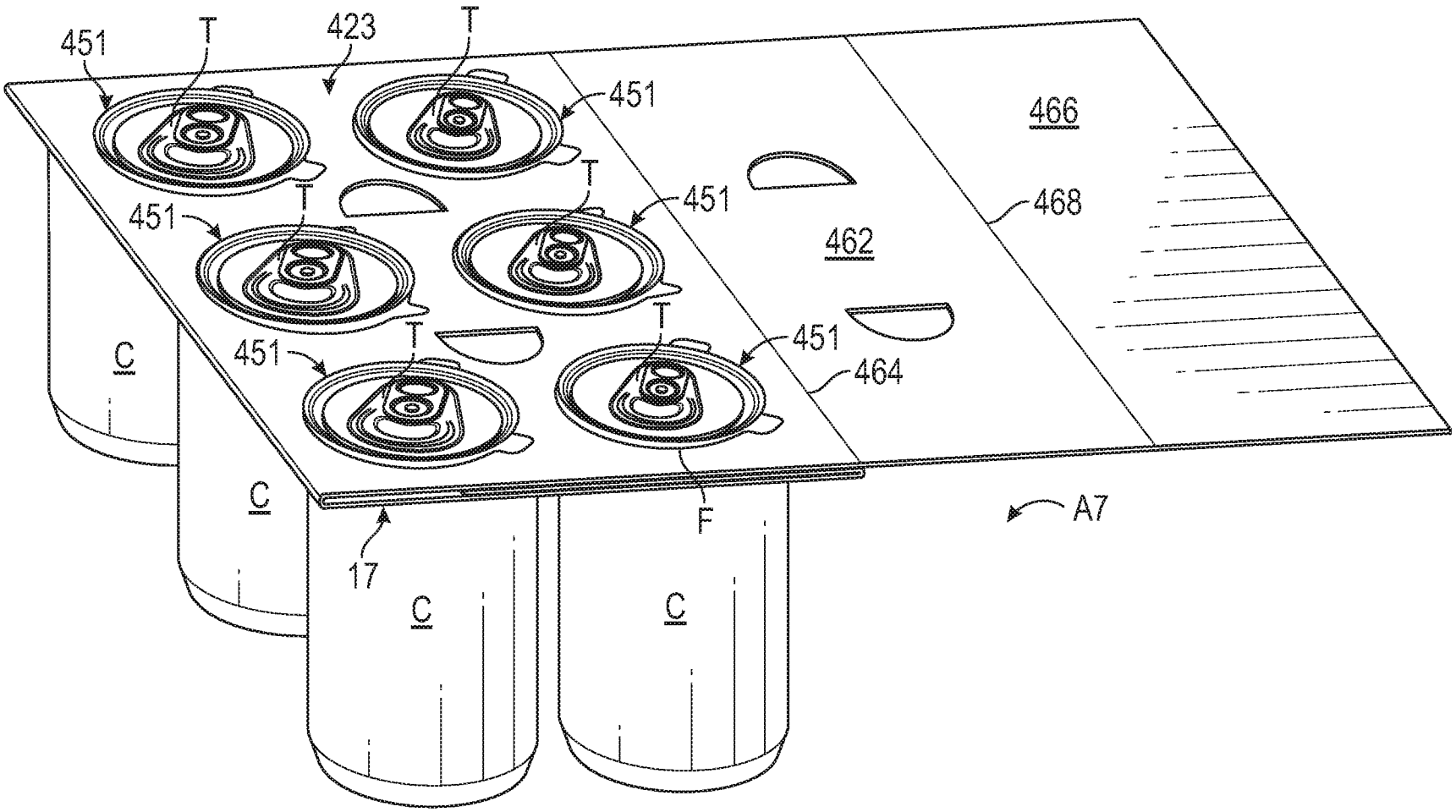
FIG. 19 is a perspective view of another partially folded configuration of the blank of FIG. 17.

Referring additionally to FIGS. 18 and 19, the blank 413 can be placed atop the containers C such that the retention edges 39, 43 are positioned below or in contact with the bottom surfaces of the flanges F of the containers C. Thereafter, the retention flap 119 can be folded at the fold line 121 in the direction of the arrow A5 so that the openings 151 of the first retention flap 119 are placed on top of the three containers C in one row of the containers C, with the first retention flap 119 being pressed into face-to-face contact with the central panel 17 so that the surface of the first retention flap 119 is below or in contact with the bottom surface of the flanges F of the containers C. In addition, the respective curved notches 161 defined along the free edge of the retention flap 119 can also rest against and/or at least partially engage the bottom surfaces of the flanges F of the respective containers C in the first row of containers C. Such additional layer of material provided by the portion of the respective retention flaps 119 can enhance the engagement of the carrier 405 with the containers C.

Next, the retention panel 423 can be folded at the fold line 425 in the direction of the arrow A6 into at least partial face-to-face contact with the respective central panel 17 and retention flap 19 and such that the retention edges 453, 457 are positioned below or in contact with the bottom surfaces of the flanges F of the containers C. Such an arrangement is illustrated in FIG. 18.

Figure 20:
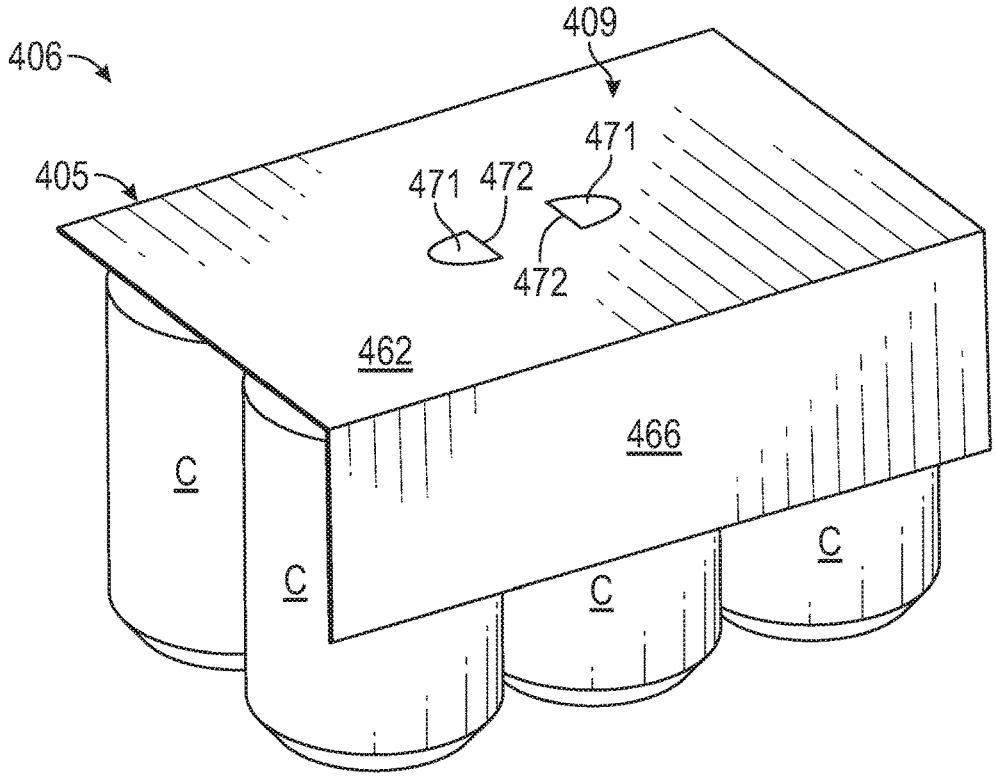
FIG. 20 is a perspective view of a package including a carrier formed from the blank of FIG. 17 and a plurality of containers.
Figure 21:
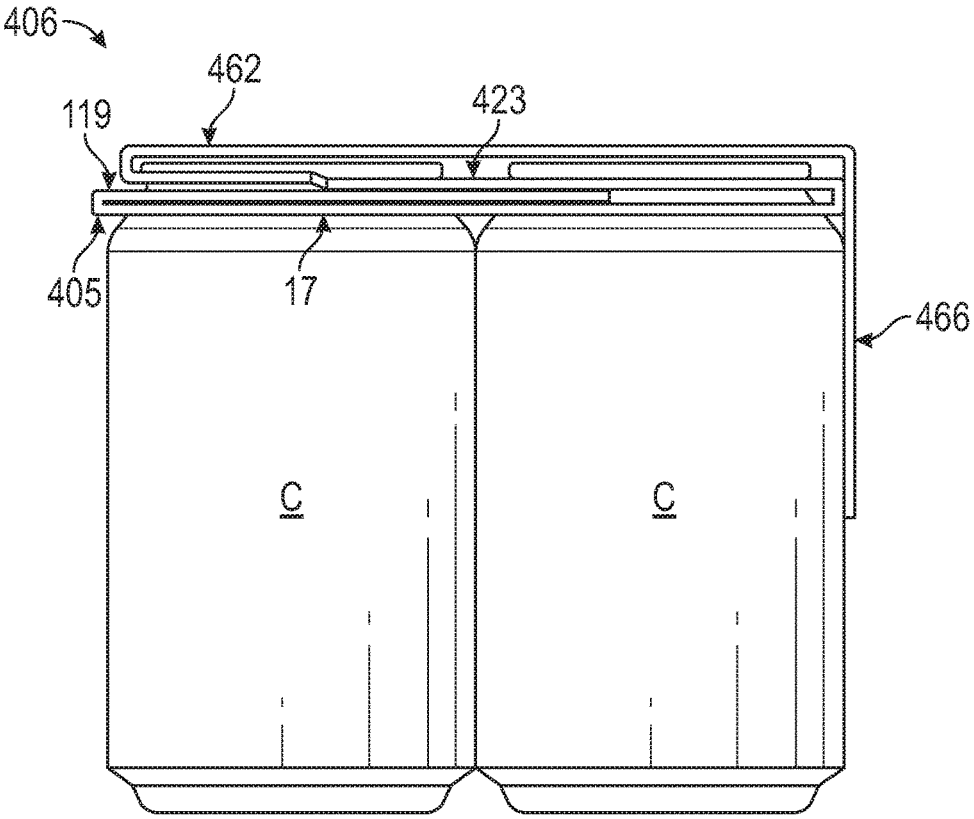
FIG. 21 is a side view of the package of FIG. 20.

Thereafter, the top panel 462 can be folded at the fold line 464 in the direction of the arrow A7 into at least partial face-to-face contact with the retention panel 423 and the billboard 466 can further be folded downwardly at the fold line 468 into a generally perpendicular arrangement relative to the top panel 462, as shown in FIGS. 19 and 20. In such an arrangement, the billboard 466 can provide a surface upon which printed indicia such as product advertising, labeling, promotional information, etc. are readily visible to a consumer browsing a retail space.

In this regard, the top panel 462 covers the handle openings 71, 173, 175 below to provide an uppermost panel of the carrier 405/package 406 that is substantially continuous or uninterrupted, as the handle flaps 471 therein are disposed in a generally coplanar arrangement with the remainder of the top panel 462. Accordingly, the top panel 462 presents a generally flat and smooth surface, e.g., a "clean" surface, that can be attractive to a customer browsing a retail space.

As described above, a handle 409 is provided by the respective overlapped handle flaps 471, the respective handle openings 173, 175 of the retention flap 19, and the handle openings 71 of the central panel 17. In this regard, a user or customer can separate the handle flaps 471 from the respective top panel 462 and retention panel 423 and fold the handle flaps 471 downwardly at the respective fold lines 472 toward the handle openings 71, 173, 175 to provide a passage through which one or more of the user's or customer's fingers can grasp a portion of the carrier 405/package 406 to move or carry the carrier 405/package 406.

Figure 22:
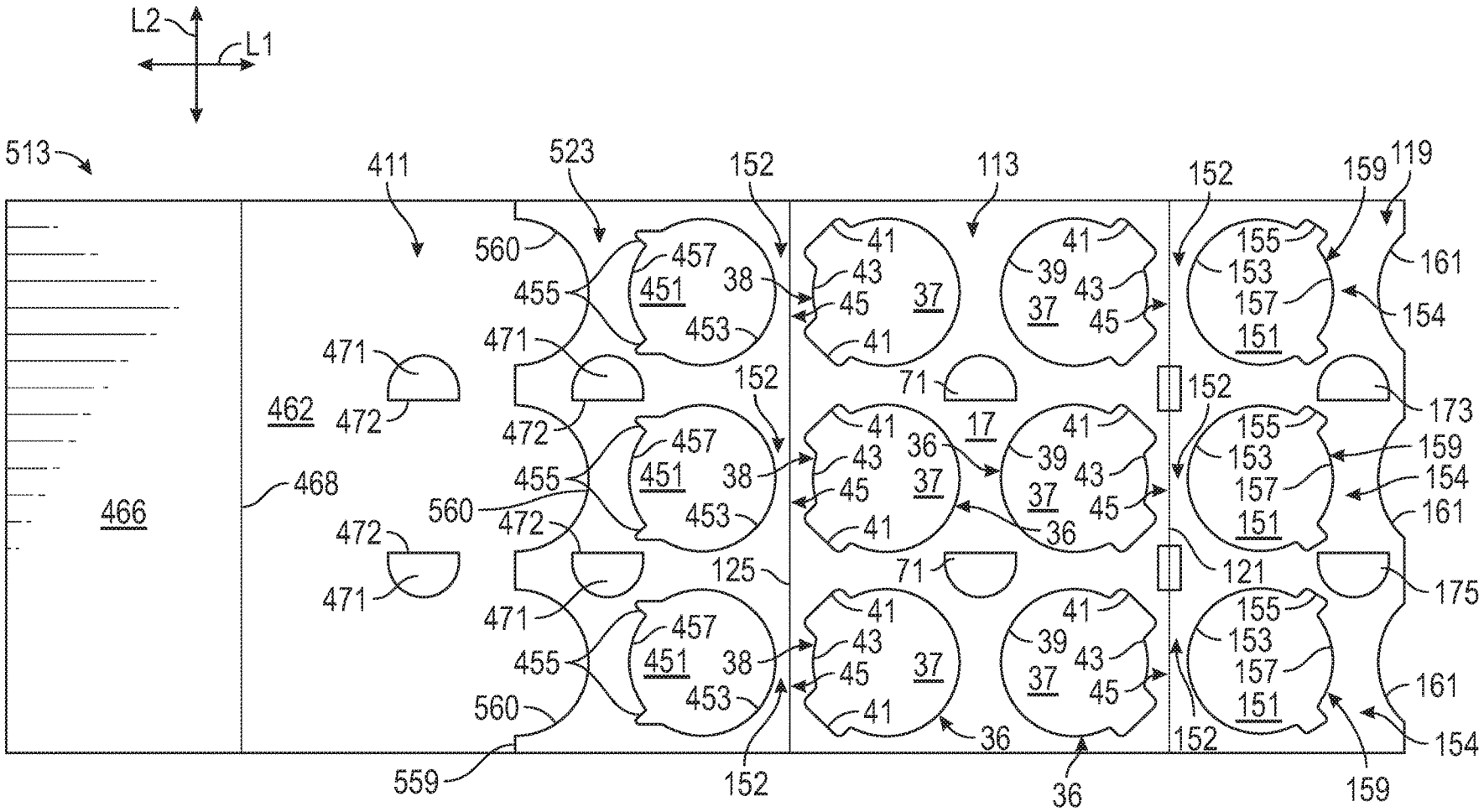
FIG. 22 is a plan view of a blank for forming a carrier according to a fifth exemplary embodiment of the disclosure.

Turning to FIG. 22, an alternative embodiment of the blank 413 is generally designated 513. The blank 513, as shown, includes the central panel 17, the retention flap 119, and a retention panel 523 that includes a first row of the openings 451. Instead of a second row of openings 451, the retention panel 523 includes a lateral line of weakening 559 that includes a set of laterally-spaced cuts 560 that can define respective notches along the retention panel 523 upon formation of a carrier 505/package 506 from the blank 513.

Figure 23:
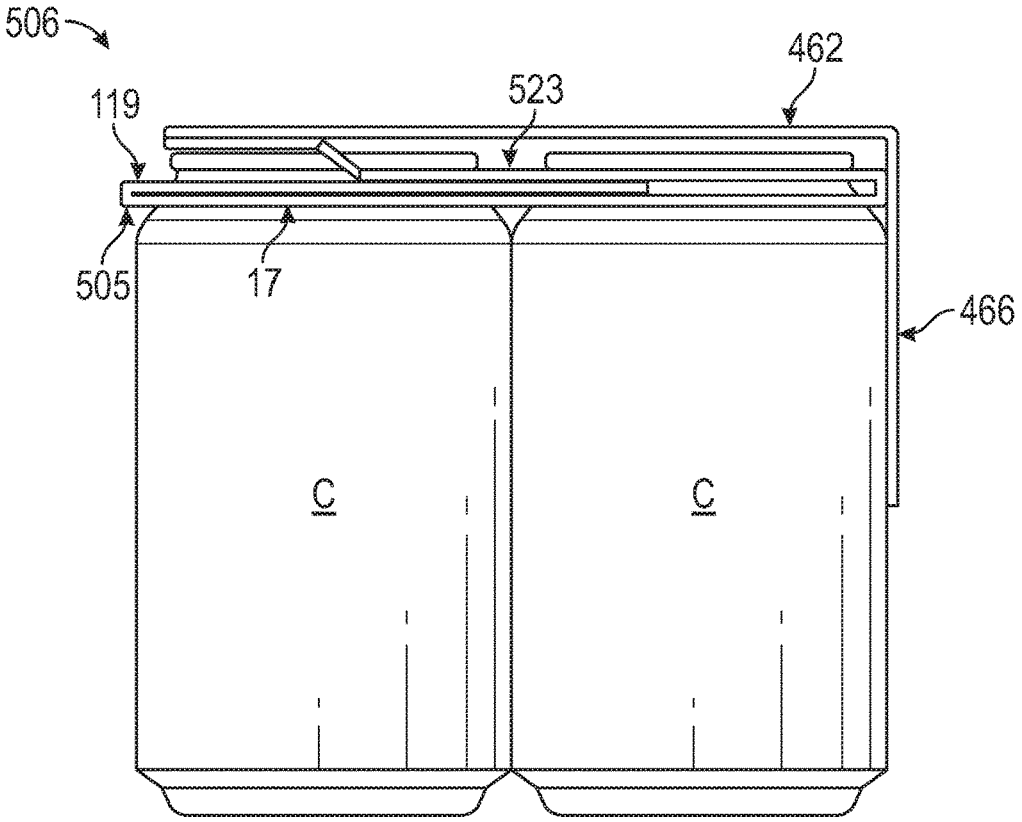
FIG. 23 is a side view of a package including a carrier formed from the blank of FIG. 22 and a plurality of containers.

The blank 513 can be formed into the carrier 505 and a package 506 that includes the carrier 505 and one or more containers C in a substantially similar manner as that described above with respect to the carrier 405/package 406. A side view of the carrier 505/package 506 is illustrated in FIG. 23, in which the top panel 462 presents a "clean" top of the carrier 505/package 506 and the billboard 466 presents a readily viewable surface for visual indicia as described above.

Figure 24:
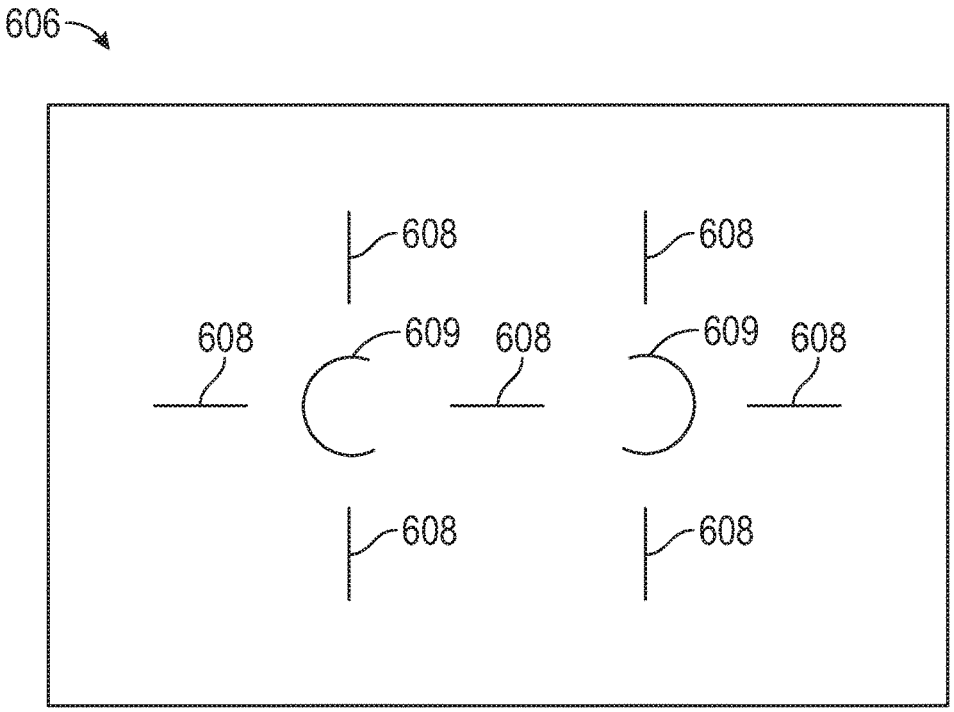
FIG. 24 is a plan view of a liner for use with carriers and packages according to the present disclosure.

Referring to FIG. 24, a liner 606 for use with any of the preceding carriers/packages is illustrated. As described herein, the liner 606 can be provided on the tops T of the containers C in a package, e.g., as a sanitary barrier, to convey a sense of cleanliness to a customer, etc. In one embodiment, the liner 606 can be a flexible material such as paper, a polymeric sheet, another suitable material etc. As shown, the liner 606 can have perforations or cuts 608 that aid in the application of the liner 606 over the top portions T and flanges F of the containers C. The perforations 608 allow the liner 606 to flex and fit tightly around the flanges F of respective containers C such that the perforations 608 can expand when a package is formed. In addition, the liner 606 can include arcuate cuts 609 that are positioned to align with the handle features of a carrier/package, e.g., so that the liner 606 does not obstruct a user or customer's carrying of the carrier/package. The liner 606 could be otherwise shaped, arranged, and/or configured to have other features without departing from the disclosure.

In one embodiment, the liner 606 can be separated or cut from a sheet that overlies sequential carriers that are, for example, being transported along a conveyor or other assembly system such that multiple separate packages can be formed with a respective liner 606.

Figure 25:
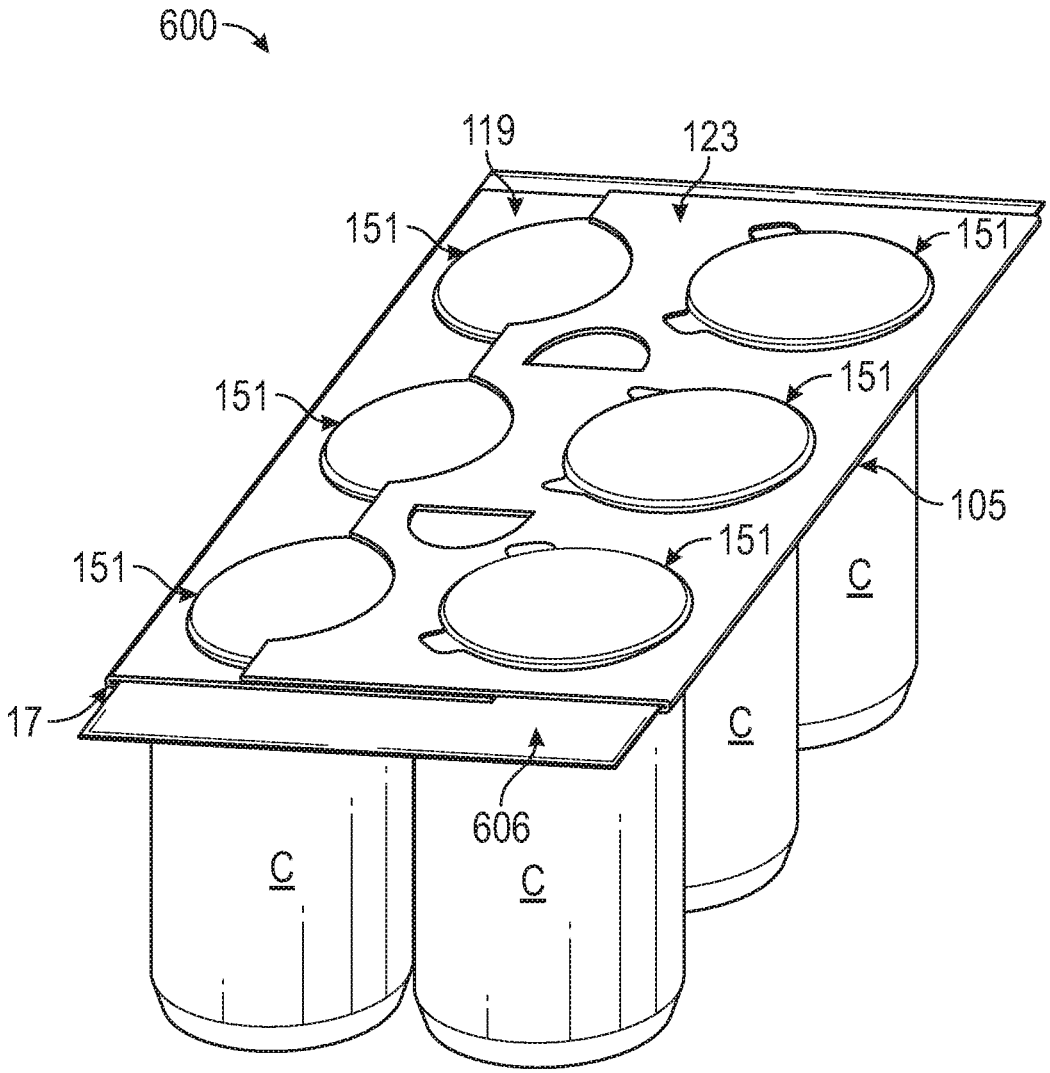
FIG. 25 is a perspective view of a package including the carrier of FIG. 8, the liner of FIG. 24, and a plurality of containers.

Turning to FIG. 25, a package 600 is illustrated according to an exemplary embodiment of the disclosure. A shown, the package 600 includes the carrier 105 described above with the liner 606 overlying the tops T of the respective containers C. In one embodiment, the liner 606 can be placed in an overlapping arrangement with the central panel 17, e.g., before the retention flaps 19, 23 are folded downwardly thereupon. In this regard, the liner 606 can be positioned to cover the portions of the containers C received in and exposed through the openings 37 of the central panel 17, and can further extend upwardly through the openings 151 of the retention flaps 119, 123, for example, for visibility to a customer. In another embodiment, the liner 606 can be positioned in a different arrangement with respect to the carrier 105/containers C, for example, atop the containers C and below the central panel 17.

As described above, the liner 606 can be provided with a different carrier described herein to provide a package with the advantageous sanitary properties described above.

The blanks according to the present disclosure can be, for example, formed from coated paperboard and similar materials. For instance, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the disclosure, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, the carrier comprises:

a central panel for engaging the plurality of containers;

at least one attachment feature in the central panel that receives and holds a top portion of a respective container of the plurality of containers, the at least one attachment feature comprises an opening in the central panel, a first retention feature defining a first portion of the opening and a second retention feature defining a second portion of the opening, the first retention feature comprises a first retention edge of the central panel for engaging a first portion of the respective container of the plurality of containers to at least partially attach the respective container to the carrier, and a first uninterrupted marginal portion of the central panel extending from the first retention edge, the second retention feature comprises a second retention edge of the central panel for engaging a second portion of the respective container of the plurality of containers to at least partially attach the respective container to the carrier, and a second uninterrupted marginal portion of the central panel extending from the second retention edge, the first retention edge defines the first portion of the opening and the second retention edge defines the second portion of the opening, the at least one attachment feature further comprises at least one flexible feature between the first uninterrupted marginal portion and the second uninterrupted marginal portion, the at least one flexible feature allows the central panel to flex without weakening the central panel when the respective container is inserted into the opening, the at least one flexible feature comprises a cutout.

2. The carrier of claim 1, wherein at least one of the first uninterrupted marginal portion and the second uninterrupted marginal portion extends generally horizontally and is generally coplanar with a remainder of the central panel.

3. The carrier of claim 1, wherein the at least one flexible feature comprises an area of weakening extending inward from at least one of the first retention edge and the second retention edge.

4. The carrier of claim 1, wherein the at least one flexible feature comprises a first flexible feature and a second flexible feature spaced apart from each other around the perimeter of the opening.

5. The carrier of claim 4, wherein the first uninterrupted marginal portion extends around the perimeter of the opening from the first flexible feature to the second flexible feature.

6. The carrier of claim 5, wherein the second uninterrupted marginal portion comprises a tab that extends between the first flexible feature and the second flexible feature.

7. The carrier of claim 1, further comprising at least one retention flap foldably connected to the central panel, the at least one attachment feature is a first attachment feature, the at least one attachment feature comprises a second attachment feature in the at least one retention flap for cooperating with the first attachment feature in the central panel when the at least one retention flap is in face-to-face contact with the central panel.

8. The carrier of claim 7, wherein the second attachment feature comprises an opening in the at least one retention flap, a third retention feature defining a first portion of the opening in the at least one retention flap and a fourth retention feature defining a second portion of the opening in the at least one retention flap.

9. The carrier of claim 8, wherein the third retention feature comprises a first retention edge of the at least one retention flap for engaging a first portion of the respective container of the plurality of containers to at least partially attach the respective container to the carrier, the fourth retention feature comprises a second retention edge of the at least one retention flap for engaging a second portion of the respective container of the plurality of containers to at least partially attach the respective container to the carrier, the first retention edge defines the first portion of the opening and the second retention edge defines the second portion of the opening.

10. The carrier of claim 9, wherein the third retention feature comprises a first uninterrupted marginal portion of the at least one retention flap extending from the first retention edge and the fourth retention feature comprises a second uninterrupted marginal portion of the central panel extending from the second retention edge, the second attachment feature further comprises at least one flexible feature between the first uninterrupted marginal portion of the at least one retention flap and the second uninterrupted marginal portion of the at least one retention flap, the at least one flexible feature allows the at least one retention flap to flex without weakening the at least one retention flap when the respective container is inserted into the opening in the at least one retention flap.

11. The carrier of claim 10, wherein the at least one flexible feature comprises an area of weakening extending inward from at least one of the first retention edge and the second retention edge, the at least one flexible feature comprises two openings and the fourth retention feature comprises a tab extending between the openings of the at least one flexible feature.

12. A blank for forming a carrier for holding a plurality of containers, the blank comprises:

a central panel and at least one attachment feature in the central panel that receives and holds a top portion of a respective container of the plurality of containers when the carrier is formed from the blank, the at least one attachment feature comprises an opening in the central panel, a first retention feature defining a first portion of the opening and a second retention feature defining a second portion of the opening, the first retention feature comprises a first retention edge of the central panel for engaging a first portion of the respective container of the plurality of containers to at least partially attach the respective container to the carrier formed from the blank and a first uninterrupted marginal portion of the central panel extending from the first retention edge, the second retention feature comprises a second retention edge of the central panel for engaging a second portion of the respective container of the plurality of containers to at least partially attach the respective container to the carrier formed from the blank and a second uninterrupted marginal portion of the central panel extending from the second retention edge, the first retention edge defines the first portion of the opening and the second retention edge defines the second portion of the opening, the at least one attachment feature further comprises at least one flexible feature between the first uninterrupted marginal portion and the second uninterrupted marginal portion, the at least one flexible feature allows the central panel to flex without weakening the central panel when the respective container is inserted into the opening, the at least one flexible feature comprises a cutout.

13. The blank of claim 12, wherein at least one of the first uninterrupted marginal portion and the second uninterrupted marginal portion extends generally horizontally and are generally coplanar with a remainder of the central panel.

14. The blank of claim 12, wherein the at least one flexible feature comprises an area of weakening extending inward from at least one of the first retention edge and the second retention edge.

15. The blank of claim 12, wherein the at least one flexible feature comprises a first flexible feature and a second flexible feature spaced apart from each other around the perimeter of the opening.

16. The blank of claim 15, wherein the first uninterrupted marginal portion extends around the perimeter of the opening from the first flexible feature to the second flexible feature.

17. The blank of claim 16, wherein the second uninterrupted marginal portion comprises a tab that extends between the first flexible feature and the second flexible feature.

18. The blank of claim 12, further comprising at least one retention flap foldably connected to the central panel, the at least one attachment feature is a first attachment feature, the at least one attachment feature comprises a second attachment feature in the at least one retention flap for cooperating with the first attachment feature in the central panel when the at least one retention flap is in face-to-face contact with the central panel when the carrier is formed from the blank.

19. The blank of claim 18, wherein the second attachment feature comprises an opening in the at least one retention flap, a third retention feature defining a first portion of the opening in the at least one retention flap and a fourth retention feature defining a second portion of the opening in the at least one retention flap.

20. The blank of claim 19, wherein the third retention feature comprises a first retention edge of the at least one retention flap for engaging a first portion of a respective container of the plurality of containers to at least partially attach the respective container to the carrier formed from the blank, the fourth retention feature comprises a second retention edge of the at least one retention flap for engaging a second portion of the respective container of the plurality of containers to at least partially attach the respective container to the carrier formed from the blank, the first retention edge defines the first portion of the opening and the second retention edge defines the second portion of the opening.

21. The blank of claim 20, wherein the third retention feature comprises a first uninterrupted marginal portion of the at least one retention flap extending from the first retention edge and the fourth retention feature comprises a second uninterrupted marginal portion of the central panel extending from the second retention edge, the second attachment feature further comprises at least one flexible feature between the first uninterrupted marginal portion of the at least one retention flap and the second uninterrupted marginal portion of the at least one retention flap, the at least one flexible feature allows the at least one retention flap to flex without weakening the at least one retention flap when the respective container is inserted into the opening in the at least one retention flap.

22. The blank of claim 21, wherein the at least one flexible feature comprises an area of weakening extending inward from at least one of the first retention edge and the second retention edge, the at least one flexible feature comprises two openings and the fourth retention feature comprises a tab extending between the openings of the at least one flexible feature.

23. A method of forming a package, the method comprises:

obtaining a carrier comprising a central panel and at least one attachment feature in the central panel, the at least one attachment feature comprises an opening in the central panel, a first retention feature defining a first portion of the opening and second retention feature defining a second portion of the opening, the first retention feature comprises a first retention edge of the central panel and a first uninterrupted marginal portion of the central panel extending from the first retention edge, and the second retention feature comprises a second retention edge of the central panel and a second uninterrupted marginal portion of the central panel extending from the second retention edge, the first retention edge defines the first portion of the opening and the second retention edge defines the second portion of the opening, the at least one attachment feature further comprises at least one flexible feature between the first uninterrupted marginal portion and the second uninterrupted marginal portion, the at least one flexible feature comprises a cutout;

receiving a top portion of a respective container of the plurality of containers in the opening; and engaging the first retention edge with a first portion of the respective container and engaging the second edge with a second portion of the respective container to at least partially attach the respective container to the carrier such that the at least one flexible feature allows the central panel to flex without weakening the central panel when the respective container is inserted into the opening.

24. The method of claim 23, wherein at least one of the first uninterrupted marginal portion and the second uninterrupted marginal portion extends generally horizontally and are generally coplanar with a remainder of the central panel.

25. The method of claim 23, wherein the at least one flexible feature comprises an area of weakening extending inward from at least one of the first retention edge and the second retention edge.

26. The method of claim 23, wherein the at least one flexible feature comprises a first flexible feature and a second flexible feature spaced apart from each other around the perimeter of the opening.

27. The method of claim 26, wherein the first uninterrupted marginal portion extends around the perimeter of the opening from the first flexible feature to the second flexible feature.

28. The method of claim 27, wherein the second uninterrupted marginal portion comprises a tab that extends between the first flexible feature and the second flexible feature.

29. The method of claim 23, further comprising at least one retention flap foldably connected to the central panel, the at least one attachment feature is a first attachment feature, the at least one attachment feature comprises a second attachment feature in the at least one retention flap for cooperating with the first attachment feature in the central panel when the retention flap is in face-to-face contact with the central panel.

30. The method of claim 29, wherein the second attachment feature comprises an opening in the at least one retention flap, a third retention feature defining a first portion of the opening in the at least one retention flap and a fourth retention feature defining a second portion of the opening in the at least one retention flap.

31. The method of claim 30, wherein the third retention feature comprises a first retention edge of the at least one retention flap for engaging a first portion of the respective container of the plurality of containers to at least partially attach the respective container to the carrier, the fourth retention feature comprises a second retention edge of the at least one retention flap for engaging a second portion of the respective container of the plurality of containers to at least partially attach the respective container to the carrier, the first retention edge defines the first portion of the opening and the second retention edge defines the second portion of the opening.

32. The method of claim 31, wherein the third retention feature comprises a first uninterrupted marginal portion of the at least one retention flap extending from the first retention edge and the fourth retention feature comprises a second uninterrupted marginal portion of the central panel extending from the second retention edge, the second attachment feature further comprises at least one flexible feature between the first uninterrupted marginal portion of the at least one retention flap and the second uninterrupted marginal portion of the at least one retention flap, the at least one flexible feature allows the at least one retention flap to flex without weakening the at least one retention flap when the respective container is inserted into the opening in the at least one retention flap.

33. The method of claim 32, wherein the at least one flexible feature comprises an area of weakening extending inward from at least one of the first retention edge and the second retention edge, the at least one flexible feature comprises two openings and the fourth retention feature comprises a tab extending between the openings of the at least one flexible feature.

* * * * *